US008475292B2

(12) United States Patent
Rahrig et al.

(10) Patent No.: US 8,475,292 B2
(45) Date of Patent: Jul. 2, 2013

(54) WOOD-TYPE GOLF CLUBS WITH TUBING AND WEIGHTS

(75) Inventors: Donald S. Rahrig, Mansfield, TX (US); Robert Boyd, Euless, TX (US); James S. Thomas, Fort Worth, TX (US)

(73) Assignee: Nike, Inc., Beaverton, OR (US)

( * ) Notice: Subject to any disclaimer, the term of this patent is extended or adjusted under 35 U.S.C. 154(b) by 434 days.

(21) Appl. No.: 12/774,424

(22) Filed: May 5, 2010

(65) Prior Publication Data

US 2011/0275446 A1 Nov. 10, 2011

(51) Int. Cl.
*A63B 53/04* (2006.01)

(52) U.S. Cl.
USPC ..... 473/324; 473/329; 473/334; 473/335; 473/345; 473/349

(58) Field of Classification Search
USPC ..... 473/287–292, 300–350, 409
See application file for complete search history.

(56) References Cited

U.S. PATENT DOCUMENTS

| | | | | |
|---|---|---|---|---|
| 1,658,581 | A * | 2/1928 | Tobia | 473/346 |
| 4,010,958 | A | 3/1977 | Long | |
| 4,511,145 | A * | 4/1985 | Schmidt | 473/346 |
| 5,000,454 | A * | 3/1991 | Soda | 473/346 |
| 5,709,615 | A * | 1/1998 | Liang | 473/324 |
| 5,839,975 | A | 11/1998 | Lundberg | |
| 5,908,357 | A * | 6/1999 | Hsieh | 473/327 |
| 5,997,415 | A | 12/1999 | Wood | |
| 6,017,280 | A | 1/2000 | Hubert | |
| 6,059,669 | A | 5/2000 | Pearce | |
| 6,319,148 | B1 | 11/2001 | Tom | |
| 6,454,665 | B2 * | 9/2002 | Antonious | 473/346 |
| 6,524,197 | B2 * | 2/2003 | Boone | 473/324 |
| 6,558,271 | B1 * | 5/2003 | Beach et al. | 473/327 |
| 6,958,019 | B2 * | 10/2005 | Rohrer | 473/324 |
| 7,351,161 | B2 * | 4/2008 | Beach | 473/334 |
| 7,462,112 | B1 | 12/2008 | Sung | |
| 7,632,193 | B2 * | 12/2009 | Thielen | 473/334 |
| 7,785,212 | B2 * | 8/2010 | Lukasiewicz et al. | 473/332 |
| 2007/0142123 | A1 * | 6/2007 | Franklin | 473/340 |

FOREIGN PATENT DOCUMENTS

JP 4347179 12/1992

OTHER PUBLICATIONS

International Search Report in corresponding PCT Application No. PCT/US2011/032614; dated Sep. 21, 2011.
International Preliminary Report in corresponding PCT Application No. PCT/US2011/032614; dated Nov. 15, 2012.

* cited by examiner

*Primary Examiner* — Sebastiano Passaniti
(74) *Attorney, Agent, or Firm* — Banner & Witcoff, Ltd.

(57) ABSTRACT

Wood-type golf clubs as described herein may include: (a) a hosel to receive a golf club shaft; (b) a club head; and (c) a ball striking face. The club head include may include: a plurality of weights, a plurality of tubes, and an exterior cover structure (e.g., an exterior skin) that covers at least a portion of the plurality of weights and at least a portion of the plurality of tubes, and wherein the exterior cover structure defines the shape of the club head. Additionally, the ball striking face may be engaged with at least two of the plurality of weights and/or at least two of the tubes. The plurality of weights may include a first weight, a second weight, a third weight, and a fourth weight that are all engaged with the striking face.

40 Claims, 18 Drawing Sheets

WOOD-TYPE GOLF CLUBS WITH TUBING AND WEIGHTS

FIELD OF THE INVENTION

This invention relates generally to golf clubs, specifically "wood-type" golf clubs. Additional aspects of this invention relate to methods for making such golf clubs, particularly drivers and fairway wood-type golf clubs that include tubing and weights and have a high moment of inertia.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Despite recent technological advances, drivers and fairway "wood-type" golf clubs can be very difficult for some players to hit consistently well. Accordingly, additional technological advances that improve a player's ability to get a golf ball airborne; increase ball flight distance, direction, and/or control; and/or otherwise improve the playability of drivers and fairway wood-type golf clubs would be welcome in the golf world.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

In general, aspects of this invention relate to wood-type golf clubs. Wood-type golf club heads in accordance with at least some examples of this invention may include one or more of the following: a hosel adapted to receive a golf club shaft, a club head, and a ball striking face. A golf club shaft may be engaged with the club head at the hosel to thereby form a wood-type golf club according to aspects of this invention. The club head may include a plurality of weights, a plurality of tubes that connect the plurality of weights, and an exterior skin. The exterior skin may cover at least a portion of the plurality of weights and at least a portion of the plurality of tubes wherein the exterior skin defines the shape of the club head. The club head may include a heel, a toe, a crown, a sole, a front, and a rear. Additionally, the ball striking face may be engaged with at least two of the plurality of weights and at least two of the tubes, wherein the ball striking face extends from the toe to the heel. The plurality of weights may include a first weight located at the front, the sole, and the toe; a second weight located at the front, the crown, and the toe; a third weight located at the front, the sole, and the heel; and a fourth weight located at the front, the crown, and the heel. The first weight, the second weight, the third weight, and the fourth weight may engage the striking face. Additionally one of the plurality of tubes connects the first weight and the second weight, one of the plurality of tubes connects the first weight and the third weight, one of the plurality of tubes connects the second weight and the fourth weight, and one of the plurality of tubes connects the third weight and the fourth weight. The tubes that connect the first weight, the second weight, the third weight, and the fourth weight may engage the striking face. Additionally, the hosel may include a pivotal portion to enable adjustment of the loft angle and the lie angle of the striking face. The fourth weight may form a portion of the hosel. The plurality of tubes may be connected to the plurality of weights by adhesives. Additionally, each of the plurality of weights may have a mass between 10 and 100 grams. Additionally, the ball striking face may be made, at least in part, from titanium metal, a titanium-containing alloy material, or aluminum.

Methods of making wood-type golf clubs in accordance with at least some examples of this invention may include, for example: (a) providing a club head, e.g., of the various types described above; (b) engaging a golf club shaft with the club head, wherein the golf club shaft is received in a hosel of the club head; and (c) engaging a grip member with the shaft. Additionally, a method of assembling a wood-type golf club in accordance with at least some examples of this invention may include, for example: (a) engaging a plurality of weights with a plurality of tubes by inserting an end of the tube into a tube receiving port of the weights; (b) connecting a ball striking face with at least two of the plurality of weights and at least two of the plurality of tubes; (c) covering at least a portion of the plurality of weights and at least a portion of the plurality of tubes with an exterior skin wherein the exterior skin defines the shape of a club head that includes a heel, a toe, a crown, a sole, a front, and a rear; (d) engaging a golf club shaft with the club head, wherein the golf club shaft is adapted to be received in a hosel of the club head; and (e) engaging a grip member with the shaft.

BRIEF DESCRIPTION OF THE DRAWINGS

A more complete understanding of the present invention and certain advantages thereof may be acquired by referring to the following detailed description in consideration with the accompanying drawings, in which:

FIGS. 4 through 10A illustrate internal top views of various wood-type golf club heads in accordance with examples of this invention;

Figure 1A:
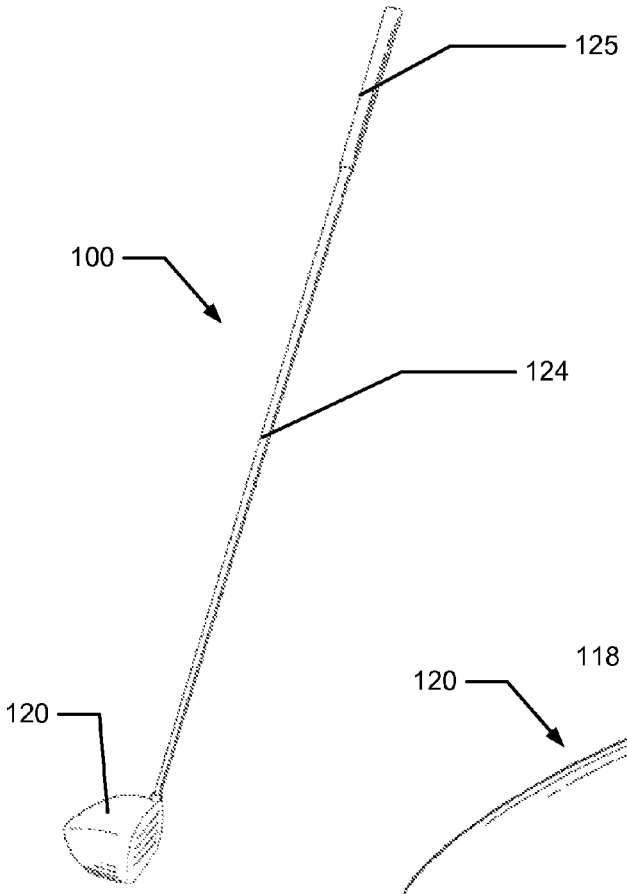
FIG. 1A illustrates a front perspective view of an example wood-type golf club according to this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example golf club heads and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Wood-Type Golf Clubs According to Examples of the Invention In general, as described above, aspects of this invention relate to wood-type golf club heads and wood-type golf clubs (such as drivers and fairway woods), as well as to methods of making and using such heads and clubs. Wood-type golf clubs according to at least some example aspects of this invention may include: (a) a hosel adapted to receive a golf club shaft; (b) a club head including: a plurality of weights, a plurality of composite tubes that connect the plurality of weights, and an exterior skin that covers the plurality of weights and the plurality of composite tubes wherein the exterior skin defines the shape of the club head that includes a heel, a toe, a crown, a sole, a front, and a rear; and (c) a ball striking face engaged with at least two of the plurality of weights and at least two of the composite tubes, wherein the ball striking face extends from the toe to the heel.

The wood-type golf club head may take on a variety of forms without departing from this invention. For example, the club head may be shaped square, rounded, triangular or any other desired shape without departing from this invention. Additionally, the club head may be made from any desired number of different weights and tubes, of any desired construction, from any desired materials, etc., without departing from this invention, including from conventional materials as are known and used in the art. In some example structures, the club head may include one or more of the following parts: a crown, a sole, a heel, a toe, a front, a rear, and a ball striking face member. The weights and tubes of the club head may include: one or more metal alloy parts, such as stainless steel, lead, tungsten, titanium alloys, aluminum alloys, magnesium alloys, etc.; polymeric materials; composite materials, including fiber or particle reinforced composite materials, such as carbon fiber composite materials, basalt fiber composite materials, fiberglass materials, etc. Any desired structure and/or arrangement of the club head structure and/or the weights and tubes may be used without departing from this invention.

Additionally, the placement, location, and mass of the weights and tubes within a given club head configuration can provide at least two advantageous features. By adding the weight low and to the rear outer sides of the club head, the moment of inertia (MOI) of the club head can be increased (particularly Izz), which is known to increase the distance and/or accuracy for off-center shots (because the club head better resists twisting about the vertical axis and/or loss of ball launch velocity due to off-center hits). Second, it may lower the center of gravity for the golf club head, making the center of gravity closer to the sole portion of the club head. The lower center of gravity will help to increase the launch angle and lower the spinrate of the golf ball, which results in improved distance.

Wood-type golf clubs in accordance with examples of this invention may include still additional features, if desired, including features that are known and used in the golf club art. For example, the wood-type golf clubs may include systems and methods for connecting golf club heads to shafts in a releasable manner so that the club heads and shafts can be readily interchanged and/or so that the angle and/or position of the shaft with respect to the club head body (and its ball striking face) can be readily changed. The club head and shaft may be interchanged with respect to one another by releasing the securing system and interchanging the originally present parts (e.g., shafts, club heads, etc.) with different parts having different characteristics. In such structures, the shaft can be quickly and easily exchanged for a different shaft on the club head body (e.g., a shaft of different length, different flex characteristics, different material, different mass, etc.). Additionally or alternatively, if desired, in such structures, the club head can be quickly and easily exchanged for a different one on the shaft (e.g., a club head of different loft, lie angle, size, brand, etc.). Additionally or alternatively, the shaft may be angled and/or the chamber for receiving the shaft may be angled with respect to the axial direction of the club head hosel or club head engaging member so as to allow adjustment of the angle or position of the shaft with respect to the club head (e.g., with respect to its ball striking face) by rotating the shaft and/or chamber with respect to the club head body.

Additionally, the releasable connection assemblies may be used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and positioning have been determined for a specific golfer, a club builder may use the determined information to then produce a final desired golf club product using conventional (and permanent) mounting techniques (e.g., cements or adhesives). Other variations in the club/shaft connection assembly parts and processes are possible without departing from this invention.

B. General Description of Example Methods of Making and/or Using Wood-Type Golf Clubs According to the Invention Additional aspects of this invention relate to methods of making wood-type golf club structures in accordance with this invention. Such methods may include, for example, one or more of the following steps: (a) providing a club head, wherein the club head includes: a plurality of weights, a plurality of tubes that connect the plurality of weights, and an exterior skin that covers the plurality of weights and the plurality of tubes wherein the exterior skin defines the shape of the club head that includes a heel, a toe, a crown, a sole, a front, and a rear; (b) providing a ball striking face engaged with at least two of the plurality of weights and at least two of the tubes, wherein the ball striking face extends from the toe to the heel; (c) engaging a golf club shaft with the club head, wherein the golf club shaft is adapted to be received in a hosel of the club head; and (d) engaging a grip member with the shaft.

Various individual weights and individual tubes of the club head and/or the ball striking face may be made with different thicknesses, mass, and shapes (e.g., a thicker center portion for the ball striking face, a thicker perimeter portion for tubes and/or weights, etc.). This change in thickness may be accomplished in any desired manner without departing from this invention. In some more specific examples, the various weights and tubes of the club head and/or the ball striking face may be made thinner and/or smaller by milling or machining processes, including chemical milling processes; by using different extrusion or molding equipment; etc.

The various parts of the golf club and the club head may be engaged together in any desired manner. As some more specific examples, the various "engaging" steps described above may include one or more of: bonding using adhesives or cements; engaging using welding, brazing, soldering, or other fusing techniques; attachment using mechanical connectors (such as screws, bolts, nuts, or the like); and the like. If desired, in some more specific example structures according to this invention, the tubing and weights of the club head structure may be adhesively bonded together, e.g., using an epoxy or cement material as are commonly known and used in the art.

Golf clubs according to at least some examples of this invention may be produced by engaging a shaft member and/or a handle member with the club head body (e.g., of the types described above). This may be accomplished in any desired manner, including in conventional manners that are well known and used in the art (e.g., via cements or adhesives, via mechanical connectors, etc.). Additionally, if desired, a grip element may be engaged with the shaft or handle member, e.g., in any desired manner, including in conventional manners that are well known and used in the art (e.g., via cements or adhesives, via mechanical connectors, etc.). Golf club heads and golf clubs in accordance with this invention may be used in conventional ways as also are known in the art.

Additionally, wood-type golf clubs may be assembled in accordance with this invention. The methods may comprise the following steps: (a) engaging a plurality of weights with a plurality of tubes by inserting an end of the tube into a tube receiving port of the weight; (b) connecting a ball striking face with at least two of the plurality of weights and at least two of the plurality of tubes; (c) covering at least a portion of the plurality of weights and at least a portion of the plurality of tubes with an exterior skin wherein the exterior skin defines the shape of a club head that includes a heel, a toe, a crown, a sole, a front, and a rear; (d) engaging a golf club shaft with the club head, wherein the golf club shaft is adapted to be received in a hosel of the club head; and (e) engaging a grip member with the shaft. Additionally, one or more of the plurality of weights may include two, three, or four tube receiving ports. In other example embodiments of the invention, one or more of the plurality of weights may include more than four tube receiving ports.

Specific examples of the invention are described in more detail below. The reader should understand that these specific examples are set forth merely to illustrate examples of the invention, and they should not be construed as limiting the invention.

C. Specific Examples of the Invention

Figure 1B:
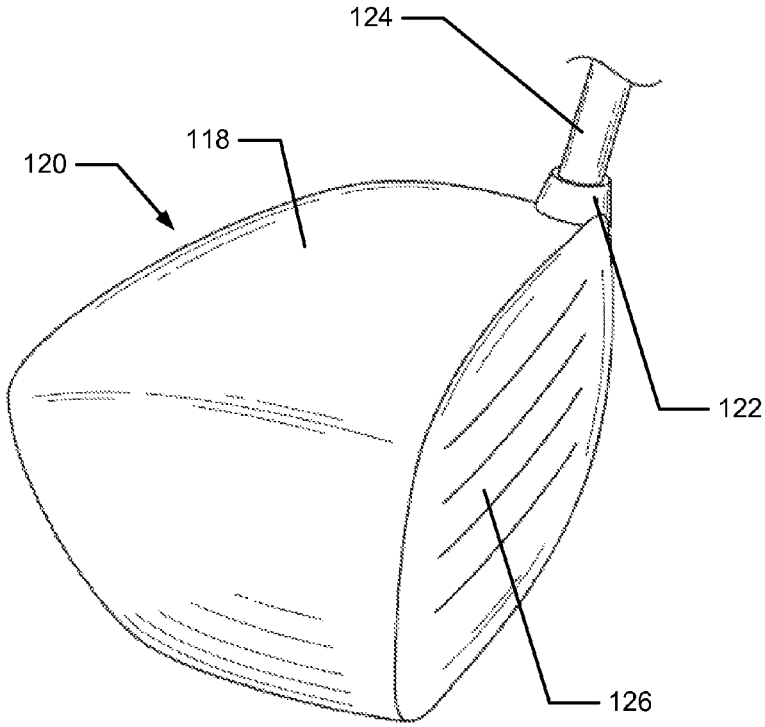
FIG. 1B illustrates a front perspective view of the wood-type golf club head of FIG. 1A.
Figure 1C:
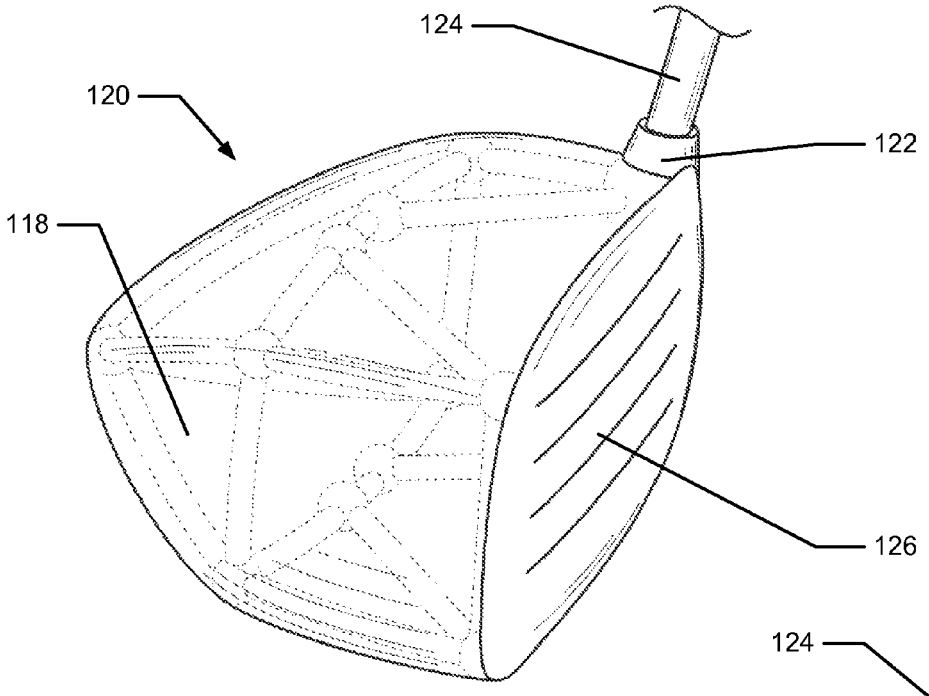
FIG. 1C illustrates an internal front perspective view of the wood-type golf club head of FIG. 1B.

FIGS. 1A and 1B generally illustrate an example wood-type golf club 100 in accordance with at least some examples of this invention. As is conventional, the wood-type golf club 100 includes a club head 120, a hosel 122 that connects the club head 120 to a shaft 124, and a grip member 125 engaged with the shaft 124. Various example features and aspects of the club head structure 120 will be described in more detail below in conjunction with the remaining figures. In some example structures according to this invention, the club head 120 may be engaged with the shaft 124 via the hosel 122 in manners that are known and used in the art (e.g., via cements or adhesives, via mechanical connections, via releasable mechanical connections, via welding, soldering, brazing, or other fusing techniques, etc.). In other example structures according to this invention and as will be discussed below, pivotal or other connections may be utilized between the shaft and the club head to enable adjustment of the shaft 124 orientation with respect to the club head 120 (e.g., to alter loft angle, lie angle, open/closed features, etc.). Any desired material may be used for the shaft member 124, including conventional materials that are known and used in the art, such as steel, graphite, polymers, composite materials, combinations of these materials, etc. Likewise, the grip member 125 may be engaged with the shaft 124 in any desired manner, including in manners that are known and used in the art (e.g., via cements or adhesives, via mechanical connections, via releasable mechanical connections, etc.). Any desired material may be used for the grip member 125, including conventional materials that are known and used in the art, such as rubber, polymeric materials, cork, rubber or polymeric materials with cord or other fabric elements embedded therein, cloth or fabric, tape, etc.

The wood-type golf clubs 100 shown in FIGS. 1 through 14B contain many common features, which are referenced by similar reference numerals in the description below. The club head 120 has a ball striking face 126. Additionally, the club head 120 generally has a top or crown 128, a bottom or sole 130, a heel 132 proximate the hosel 122, a toe 134 distal from the hosel 122, a front 136, and a back or rear 138.

As illustrated in FIGS. 2A through 3B, in accordance with at least some examples of this invention, the club head 120 includes a plurality of weights 101-113 and a plurality of tubes 115. The plurality of tubes may connect the plurality of weights such that the combination of the plurality of weights 101-113 and the plurality of tubes 115 forms the structure and shape of the club head 120. In addition, an exterior skin 118 may cover the plurality of weights 101-113 and the plurality of tubes 115.

The plurality of weights 101-113 may be made from or contain heavier materials such as: steels, lead, tungsten, etc. Additionally in some examples in accordance with this invention, the plurality of weights 101-113 may include: one or more metal alloy parts, such as stainless steel, titanium alloys, aluminum alloys, magnesium alloys, etc.; polymeric materials, etc. Any desired structure and/or arrangement of the club head 120 and/or the weights 101-113 and tubes 115 may be used without departing from this invention.

Additionally, the plurality of weights 101-113 may be of different shapes. The shapes may include, but are not limited to: spherical, ellipsoid, rectangular or square cubic, prism, irregularly shaped, etc. Additionally, each of the plurality of weights may be of similar shapes or different shapes for a singular club head 120. Additionally, each of the plurality of weights 101-113 may have similar mass or different mass for a singular club head 120. Each of the plurality of weights 101-113 may have a mass between approximately 1 gram to 15 grams. In another embodiment of this invention, each of the plurality of weights 101-113 may have a mass between approximately 1 gram to 30 grams. Additionally, one or more of the plurality of weights 101-113 may act as mere a hub for connecting the tubes 115.

Additionally, for each of the different club head 120 configurations in accordance with this invention, the location and mass of each of the plurality of weights 101-113 can be different from club head to club head 120. The location and mass of the plurality of weights 101-113 can provide at least two advantageous features for the club head 120.

Additionally, for a given golf club head 120, the weights 101-113 can be located in positions to affect the weight distribution of the different golf club heads. By using a different golf club head configuration with a different weight distribution of the golf club head 120, the club head's center of gravity may be located in a more desirable position.

For example, during a club fitting, in order to analyze a particular golfer's swing, tendencies, characteristics, etc., a club fitter could use a variety of techniques including: observation with the naked eye of either the swing and/or the golfer's body throughout the swing; recording and play back (e.g., in slow motion or real time) of the swing and/or the golfer's body throughout the swing; measurement of particular aspects of the swing including: the angle of the club head 120 and/or the shaft 124 throughout the swing (e.g., at the take away, during the downswing, at impact, during the follow through, etc.), velocity or acceleration of the club head 120 throughout the swing, etc.; computer analysis of the swing, such as computer analysis of the above mentioned measurements and recordings; etc. Upon analyzing the particular golfer's swing or tendencies (e.g., in a manner described above), a club fitter could selectively attach a club head 120 with the plurality of weights 101-113 to the shaft 124 based on the analysis of at least one characteristic of a golfer's swing in a manner to better aid a particular golfer achieve a desired result. Therefore, the club fitter may exchange or replace the existing club head 120 with other interchangeable club heads in order to better aid a particular golfer achieve a desired result. For example, if a golfer has a tendency to "slice", then the club fitter may attach a club head 120 with the plurality of weights 101-113 that provide more mass in the heel 132. Conversely, if a golfer has a tendency to "hook" the golf ball, then the club fitter may attach a club head 120 with the plurality of weights 101-113 that provide more mass in the toe 134.

The plurality of tubes 115 may include: one or more metal alloy parts, such as stainless steel, titanium alloys, aluminum alloys, magnesium alloys, etc.; polymeric materials; composite materials, including fiber or particle reinforced composite materials, such as carbon fiber composite materials, basalt fiber composite materials, fiberglass materials, etc. Any desired structure and/or arrangement of the club head 120 and/or the weights 101-113 and tubes 115 may be used without departing from this invention.

Additionally, the plurality of tubes 115 may be of different shapes which may include tubes with a cross-section in the shape of, but not be limited to: circular, oval, rectangular, triangular, square, etc. Additionally, each of the plurality of tubes may be of similar shapes or different shapes for a singular club head 120. The tubes 115 may be straight (linear), curved, bent, etc. Also, if desired, some or all of the tubes 115 may have openings through the walls thereof to reduce their weights, provided that the overall tube strength is not excessively reduced for its intended use.

Additionally, the plurality of weights 101-113 and tubes 115 of the golf club head 120 in accordance with examples of this invention may be joined together by various methods, such as through the use of cements or adhesives; mechanical connectors, optionally releasable mechanical connections; and/or welding, soldering, brazing, or other fusing techniques. If desired, a finish may be applied over to conceal the area where the parts are joined together (e.g., paint, chrome or other metal plating, polymeric coatings, etc.).

The exterior skin 118 may be used to cover the plurality of weights 101-113 and plurality of tubes 115. The exterior skin 118 may define the exterior shape of the club head 120. The exterior skin 118 may be transparent (of any desired color or colors), translucent (of any desired color or colors), or opaque (of any desired color or colors), without departing from this invention.

Figure 1D:
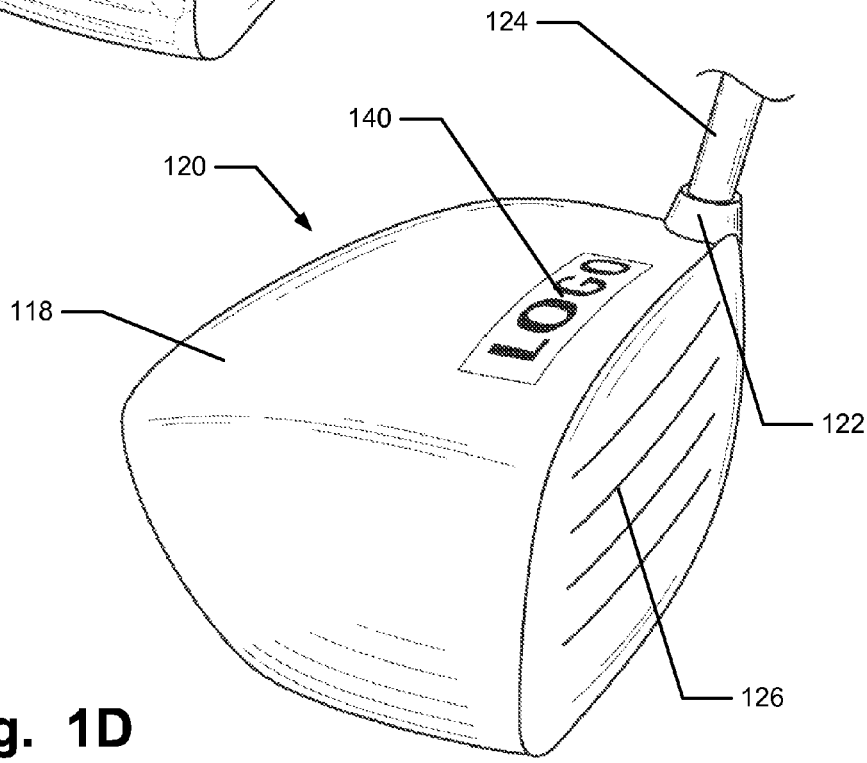
FIG. 1D illustrates a front perspective view of another wood-type golf club head in accordance with another example of this invention.

Additionally, the exterior skin 118 may include one or more pieces connected together. The exterior skin may be made from conventional materials as are known and used in the art, such as thin metals or composite crowns, soles, or club head body members. Additionally, the exterior skin 118 may be made from one or a combination of materials such as: stainless steel, titanium alloys, aluminum alloys, magnesium alloys, etc.; polymeric materials; composite materials, including fiber or particle reinforced composite materials, such as carbon fiber composite materials, basalt fiber composite materials, fiberglass materials, etc. The exterior skin 118 may optionally attach to at least one or more of the plurality of weights 101-113 and/or at least one or more of the plurality of tubes 115. Additionally, the exterior skin 118 may be customized with various designs or logos, e.g., as shown in FIG. 1D. The exterior skin 118 may also be of a thickness of approximately 0.002 inches to 0.1 inches.

The plurality of weights 101-113 may include weights located at different locations throughout the club head 120. The location of each weight within the club head 120 can be described by a location relative to one or a combination of the parts of the club head 120. For example, the location of the weight may be described relative to the crown 128 or the sole 130 of the club head 120. Additionally, the location of the weight may be described relative to the heel 132 or the toe 134 of the club head 120. Lastly, the location of the weight may be described relative to the front 136 or the rear 138 of the club head 120.

For example, as shown in FIGS. 2A, 2B, 3A, and 3B, the plurality of weights 101-113 may include thirteen different weights. A first weight 101, a second weight 102, a third weight 103, and a fourth weight 104 may be all located at the front area 136 of the club head 120. The first weight 101, the second weight 102, the third weight 103, and the fourth weight 104 may all be engaged with the striking face 126. A gasket or gasket-type material (not shown) may be included between the first weight 101, the second weight 102, the third weight 103, and the fourth weight 104 engagement with the striking face 126. Additionally, a fifth weight 105, a sixth weight 106, a seventh weight 107, an eighth weight 108, a ninth weight 109, a tenth weight 110, an eleventh weight 111, and a twelfth weight 112 may all be located approximately midway between the front 136 of the club head 120 and the rear 138 of the club head 120. Lastly, a thirteenth weight 113 may be located at the rear 138 of the club head 120.

Additionally, a portion of the plurality of weights 101-113 may be located near the sole 130 of the club head 120 and a portion of the plurality of weights 101-113 may be located near the crown 128 of the club head 120. The first weight 101, the third weight 103, the fifth weight 105, the seventh weight 107, the eighth weight 108, and the eleventh weight 111 in this example structure 120 are all located at the sole portion 130 of the club head 120. Conversely, the second weight 102, the fourth weight 104, the sixth weight 106, the ninth weight 109, the tenth weight 110, and the twelfth weight 112 are all located at the crown portion 128 of this example club head 120.

Figure 2A:
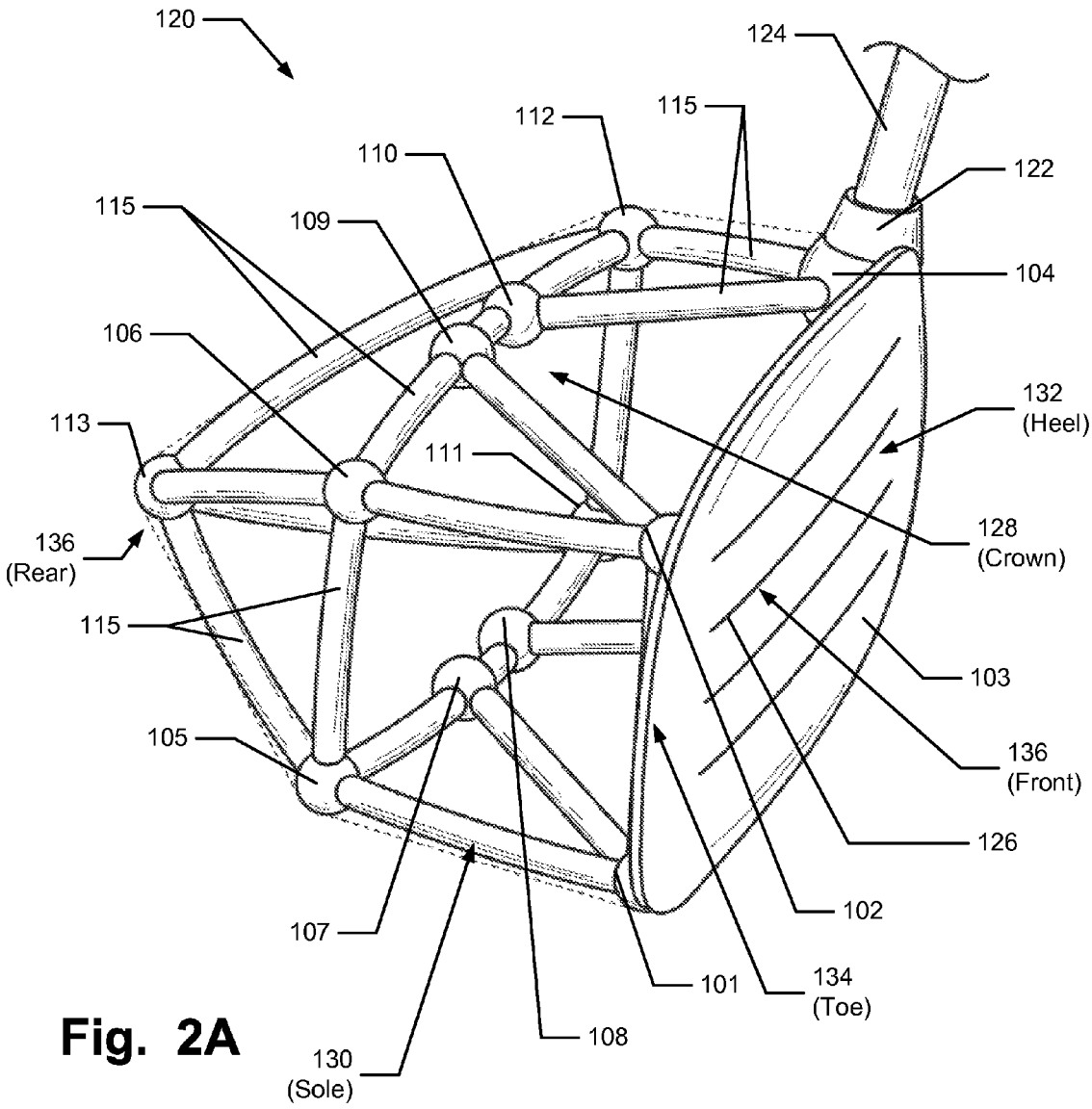
FIG. 2A illustrates an internal front perspective view of the wood-type golf club head of FIG. 1C showing a plurality of weights and a plurality of tubes.
Figure 2B:
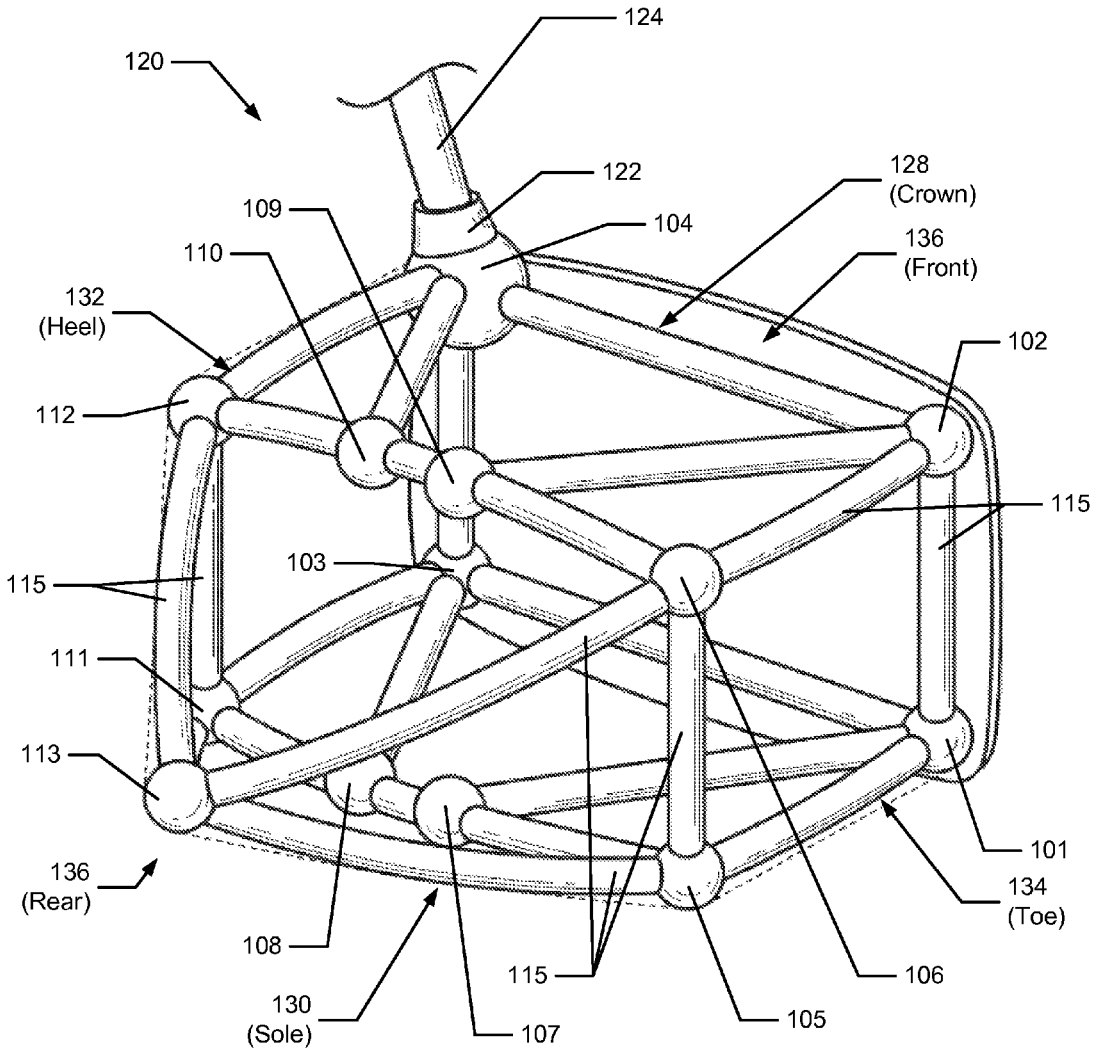
FIG. 2B illustrates an internal rear perspective view of the wood-type golf club head of FIG. 1C showing the plurality of weights and the plurality of tubes.
Figure 3A:
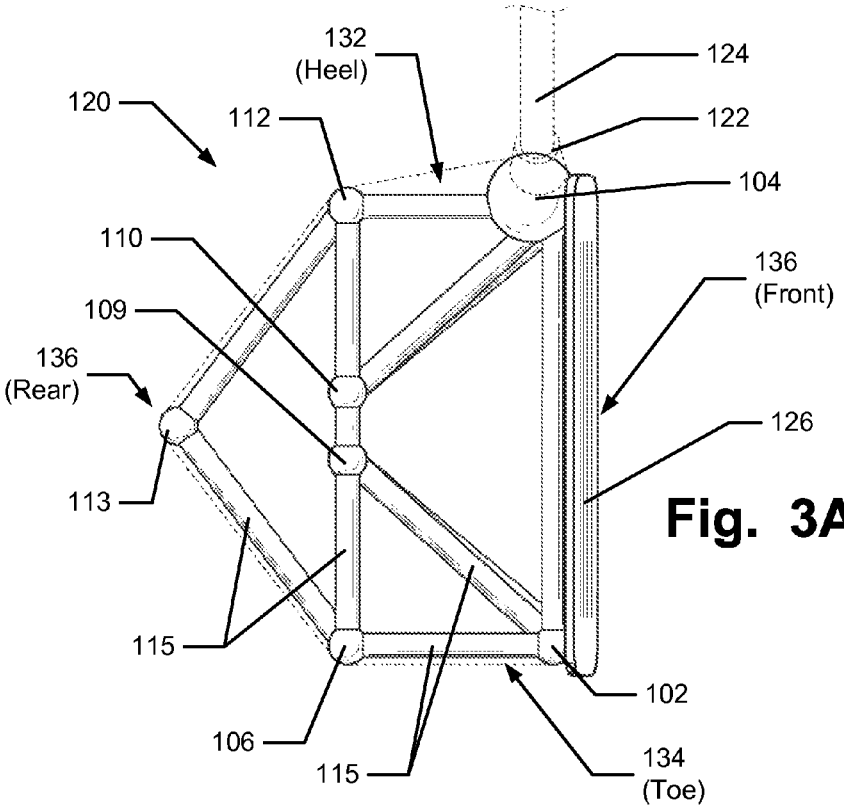
FIG. 3A illustrates an internal top view of the wood-type golf club head of FIG. 1C.
Figure 3B:
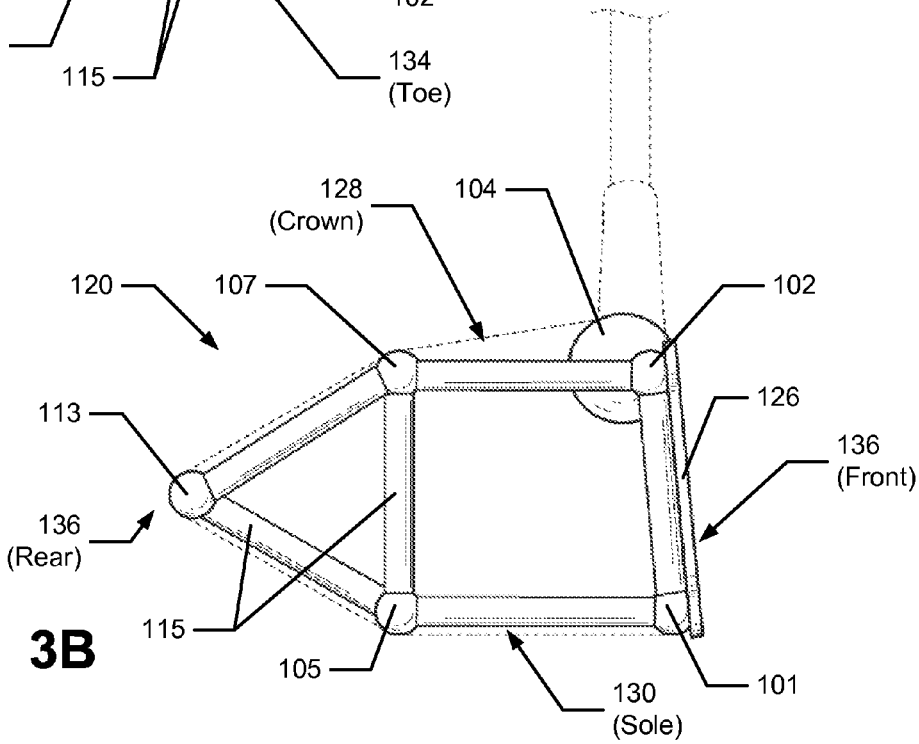
FIG. 3B illustrates an internal side view of the wood-type golf club head of FIG. 1C.

Specifically, as illustrated in FIGS. 2A and 2B, the first weight 101 may be located generally at the front area 136, the sole area 130, and the toe area 134 of the club head 120. The second weight 102 may be located generally at the front area 136, the crown area 128, and the toe area 134 of the club head 120. The third weight 103 may be located generally at the front area 136, the sole area 130, and the heel area 132 of the club head 120. The fourth weight 104 may be located generally at the front area 136, the crown area 128, and the heel area 132 of the club head 120. Additionally, if desired, the fourth weight 104 may form at least a portion of the hosel 122. The fifth weight 105 may be located generally midway between the front area 136 and the rear area 138, at the sole area 130, and at the toe area 134 of the club head 120. The sixth weight 106 may be located generally midway between the front area 136 and the rear area 138, at the crown area 128, and at the toe area 134 of the club head 120. The seventh weight 107 and eighth weight 108 may be located generally midway between the front area 136 and the rear area 138, at the sole area 130, and midway between the toe area 134 and the heel area 132 of the club head 120. The ninth and tenth weights, 109 and 110, respectively, may be located generally midway between the front area 136 and the rear area 138, at the crown area 130, and midway between the toe area 134 and the heel area 132 of the club head 120. The eleventh weight 111 may be located generally midway between the front area 136 and the rear area 138, at the sole area 130, and at the heel area 132 of the club head 120. The twelfth weight 112 may be located generally midway between the front area 136 and the rear area 138, at the crown area 128, and at the heel area 132 of the club head 120. The thirteenth weight 113 may be located generally at the rear area 138, midway between the sole area 130 and the crown area 128 (or, optionally, more toward the sole area 130), and midway between the toe area 134 and the heel area 132 of the club head 120.

Additionally, as shown in FIGS. 2A, 2B, 3A, and 3B, the plurality of tubes 115 connect each of the plurality of weights 101-113. For example, one of the plurality of tubes 115 may connect the first weight 101 and the second weight 102. Another one of the plurality of tubes 115 may connect the first weight 101 and the third weight 103. Another one of the plurality of tubes 115 may connect the second weight 102 and the fourth weight 104. Another one of the plurality of tubes 115 may connect the third weight 103 and the fourth weight 104. Each of these tubes mentioned above, connecting the first weight 101, the second weight 102, the third weight 103, and the fourth weight 104, may be engaged with and support the striking face 126.

In another example configuration according to this invention, provided that the striking face 126 is stiff enough on its own to be structurally sound, these tubes 115 mentioned above, connecting the first weight 101, the second weight 102, the third weight 103, and the fourth weight 104, may not engage with and/or support the striking face 126. In another configuration according to this invention, these tubes 115, connecting the first weight 101, the second weight 102, the third weight 103, and the fourth weight 104, may be omitted entirely from the club head 120 structure.

Additionally, another one of the plurality of tubes 115 may connect the first weight 101 and the fifth weight 105. Another one of a plurality of tubes 115 may connect the first weight 101 and the seventh weight 107. Another one of the plurality of tubes 115 may connect the second weight 102 and the sixth weight 106. Another one of the plurality of tubes 115 may connect the second weight 102 and the ninth weight 109. Another one of the plurality of tubes 115 may connect the third weight 103 and the eighth weight 108. Another one of the plurality of tubes 115 may connect the third weight 103 and the eleventh weight 111. Another one of the plurality of tubes 115 may connect the fourth weight 104 and the tenth weight 110. Another one of the plurality of tubes 115 may connect the fourth weight 104 and the twelfth weight 112. Another one of the plurality of tubes 115 may connect the fifth weight 105 and the seventh weight 107. Another one of the plurality of tubes 115 may connect the fifth weight 105 and the sixth weight 106. Another one of the plurality of tubes 115 may connect the fifth weight 105 and the thirteenth weight 113. Another one of the plurality of tubes 115 may connect the sixth weight 106 and the ninth weight 109. Another one of the plurality of tubes 115 may connect the sixth weight 106 and the thirteenth weight 113. Another one of the plurality of tubes 115 may connect the seventh weight 107 and the eighth weight 108. Another one of the plurality of tubes 115 may connect the eighth weight 108 and the eleventh weight 111. Another one of the plurality of tubes 115 may connect the ninth weight 109 and the tenth weight 110. Another one of the plurality of tubes 115 may connect the tenth weight 110 and the twelfth weight 112. Another one of the plurality of tubes 115 may connect the eleventh weight 111 and the twelfth weight 112. Another one of the plurality of tubes 115 may connect the eleventh weight 111 and the thirteenth weight 113. Another one of the plurality of tubes 115 may connect the twelfth weight 112 and the thirteenth weight 113.

Additional examples in accordance with this invention now will be described in more detail in conjunction with FIGS. 4 through 9. The wood-type golf club head 420 shown in FIG. 4 includes many features in common with the golf club head 120 shown in FIGS. 2A through 3B and described above, and common reference numerals are used to describe such common features.

Figure 4:
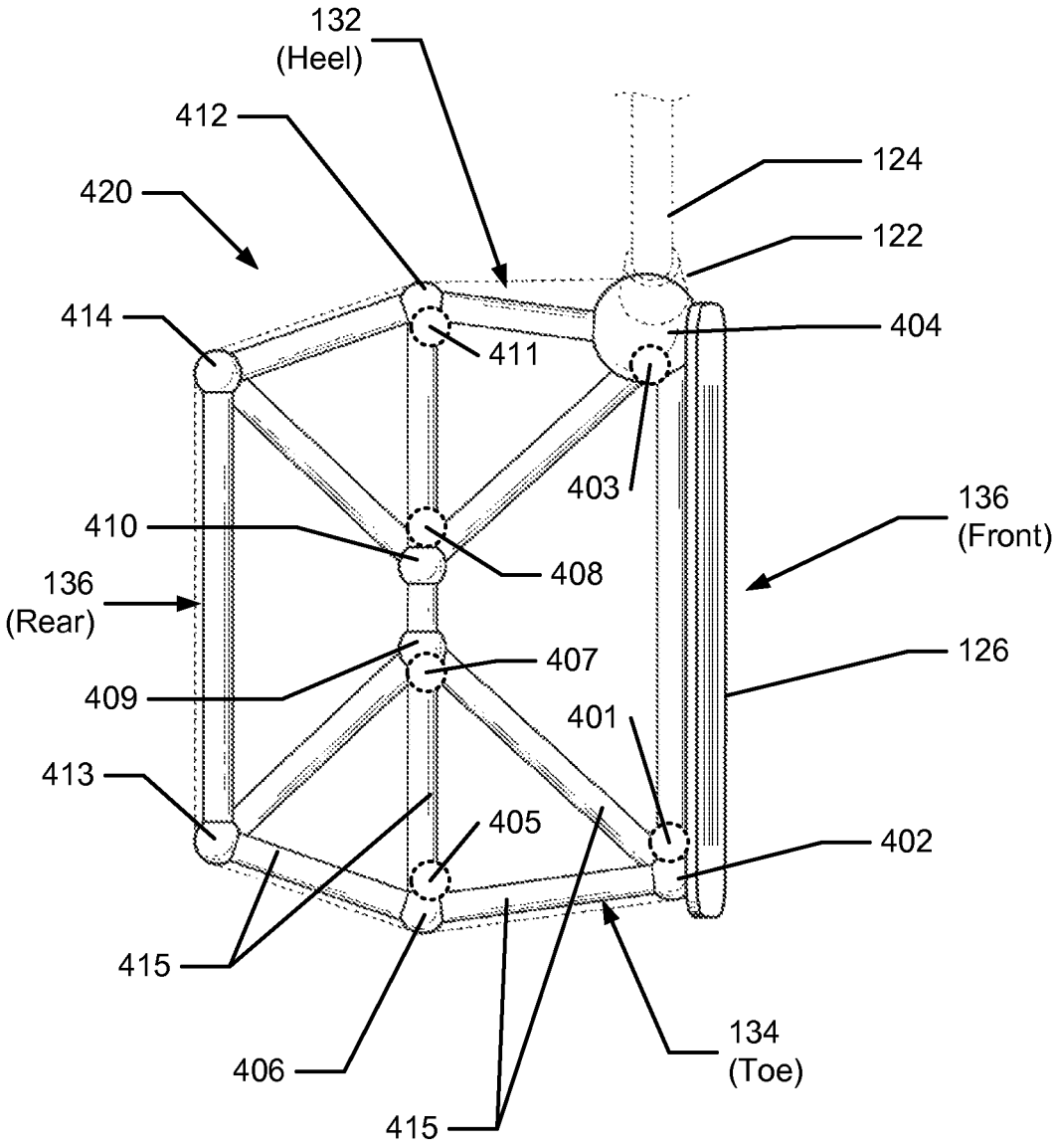

Specifically, as illustrated in FIG. 4, the first weight 401 may be located generally at the front area 136, the sole area 130, and the toe area 134 of the club head 420. The second weight 402 may be located generally at the front area 136, the crown area 128, and the toe area 134 of the club head 420. The third weight 403 may be located generally at the front area 136, the sole area 130, and the heel area 132 of the club head 420. The fourth weight 404 may be located generally at the front area 136, the crown area 128, and the heel area 132 of the club head 420. Additionally, if desired, the fourth weight 404 may form at least a portion of the hosel 122. Each of these weights, the first weight 401, the second weight 402, the third weight 403, and the fourth weight 404, may be engaged with the striking face 126.

The fifth weight 405 may be located generally midway between the front area 136 and the rear area 138, at the sole area 130, and at the toe area 134 of the club head 420. The sixth weight 406 may be located generally midway between the front area 136 and the rear area 138, at the crown area 128, and at the toe area 134 of the club head 420. The seventh weight 407 and the eighth weight 408 may be located generally midway between the front area 136 and the rear area 138, at the sole area 130, and midway between the toe area 134 and the heel area 132 of the club head 420. The ninth weight 409 and tenth weight 410 may be located generally midway between the front area 136 and the rear area 138, at the crown area 130, and midway between the toe area 134 and the heel area 132 of the club head 420. The eleventh weight 411 may be located generally midway between the front area 136 and the rear area 138, at the sole area 130, and at the heel area 132 of the club head 420. The twelfth weight 412 may be located generally midway between the front area 136 and the rear area 138, at the crown area 128, and at the heel area 132 of the club head 420. The thirteenth weight 413 may be located generally at the rear area 138, midway between the sole area 130 and the crown area 128 (or, optionally, more toward the sole area 130), and at the toe area 134 of the club head 420. The fourteenth weight 414 may be located generally at the rear area 138, midway between the sole area 130 and the crown area 128 (or, optionally, more toward the sole area 130), and at the heel area 132 of the club head 420.

Additionally, as shown in FIG. 4, the plurality of tubes 415 may connect each of the plurality of weights 401-414. For example, one of the plurality of tubes 415 may connect the first weight 401 and the second weight 402. Another one of the plurality of tubes 415 may connect the first weight 401 and the third weight 403. Another one of the plurality of tubes 415 may connect the second weight 402 and the fourth weight 404. Another one of the plurality of tubes 415 may connect the third weight 403 and the fourth weight 404. Each of these tubes, connecting the first weight 401, the second weight 402, the third weight 403, and the fourth weight 404, may be engaged with the striking face 126.

As further illustrated in FIG. 4, another one of the plurality of tubes 415 may connect the first weight 401 and the fifth weight 405. Another one of a plurality of tubes 415 may connect the first weight 401 and the seventh weight 407. Another one of the plurality of tubes 415 may connect the second weight 402 and the sixth weight 406. Another one of the plurality of tubes 415 may connect the second weight 402 and the ninth weight 409. Another one of the plurality of tubes 415 may connect the third weight 403 and the eighth weight 408. Another one of the plurality of tubes 415 may connect the third weight 403 and the eleventh weight 411. Another one of the plurality of tubes 415 may connect the fourth weight 404 and the tenth weight 410. Another one of the plurality of tubes 415 may connect the fourth weight 404 and the twelfth weight 412. Another one of the plurality of tubes 415 may connect the fifth weight 405 and the seventh weight 407. Another one of the plurality of tubes 415 may connect the fifth weight 405 and the sixth weight 406. Another one of the plurality of tubes 415 may connect the fifth weight 405 and the thirteenth weight 413. Another one of the plurality of tubes 415 may connect the sixth weight 406 and the ninth weight 409. Another one of the plurality of tubes 415 may connect the sixth weight 406 and the thirteenth weight 413. Another one of the plurality of tubes 415 may connect the seventh weight 407 and the eighth weight 408. Another one of the plurality of tubes 415 may connect the seventh weight 407 and the thirteenth weight 413. Another one of the plurality of tubes 415 may connect the eighth weight 408 and the eleventh weight 411. Another one of the plurality of tubes 415 may connect the eighth weight 408 and the fourteenth weight 414. Another one of the plurality of tubes 415 may connect the ninth weight 409 and the tenth weight 410. Another one of the plurality of tubes 415 may connect the ninth weight 409 and the thirteenth weight 413. Another one of the plurality of tubes 415 may connect the tenth weight 410 and the twelfth weight 412. Another one of the plurality of tubes 415 may connect the tenth weight 410 and the fourteenth weight 414. Another one of the plurality of tubes 415 may connect the eleventh weight 411 and the twelfth weight 412. Another one of the plurality of tubes 415 may connect the eleventh weight 411 and the fourteenth weight 414. Another one of the plurality of tubes 415 may connect the twelfth weight 412 and the fourteenth weight 414. Another one of the plurality of tubes 415 may connect the thirteenth weight 413 and the fourteenth weight 414.

Figure 5:
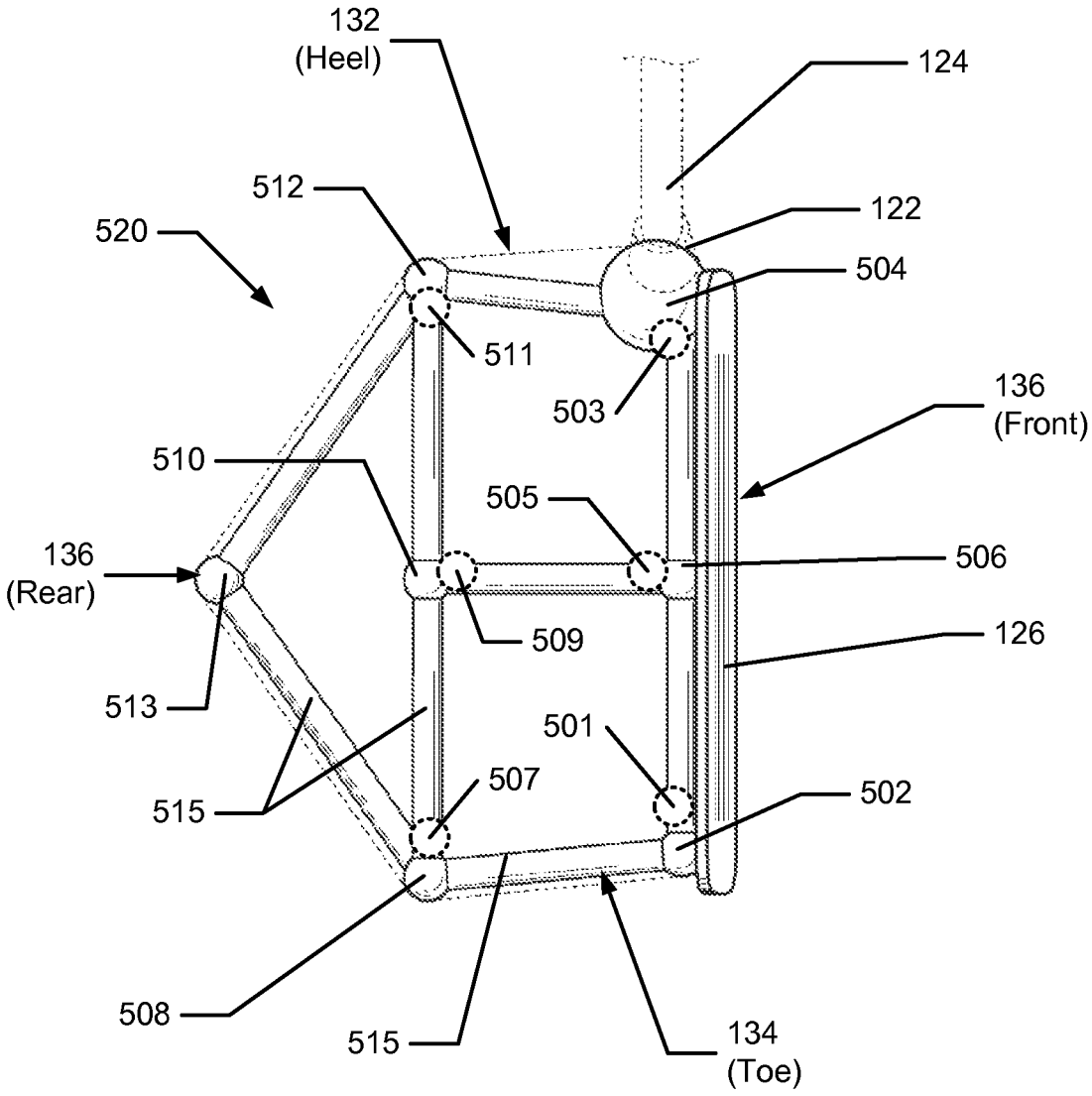

In another example in accordance with this invention, the wood-type golf club head 520 shown in FIG. 5 includes many features in common with the golf club head 120 shown in FIGS. 2A through 3B and described above, and common reference numerals are used to describe such common features.

Specifically, as illustrated in FIG. 5, the first weight 501 may be located generally at the front area 136, the sole area 130, and the toe area 134 of the club head 520. The second weight 502 may be located generally at the front area 136, the crown area 128, and the toe area 134 of the club head 520. The third weight 503 may be located generally at the front area 136, the sole area 130, and the heel area 132 of the club head 520. The fourth weight 504 may be located generally at the front area 136, the crown area 128, and the heel area 132 of the club head 520. Additionally, if desired, the fourth weight 504 may form at least a portion of the hosel 122. The fifth weight 505 may be located generally at the front area 136, at the sole area 130, and midway between the toe area 134 and the heel area 130 of the club head 520. The sixth weight 506 may be located generally at the front area 136, at the crown area 128, and midway between the toe area 134 and the heel area 132 of the club head 520. Each of these weights, the first weight 501, the second weight 502, the third weight 503, the fourth weight 504, the fifth weight 505, and the sixth weight 506 may be engaged with the striking face 126.

As further illustrated in FIG. 5, the seventh weight 507 may be located generally midway between the front area 136 and the rear area 138, at the sole 130, and at the toe area 134 of the club head 520. The eighth weight 508 may be located generally midway between the front area 136 and the rear area 138, at the sole area 130, and at the toe area 134 of the club head 520. The ninth weight 509 may be located generally midway between the front area 136 and the rear area 138, at the sole area 130, and midway between the toe area 134 and the heel area 132 of the club head 520. The tenth weight 510 may be located generally midway between the front area 136 and the rear area 138, at the crown area 130, and midway between the toe area 134 and the heel area 132 of the club head 520. The eleventh weight 511 may be located generally midway between the front area 136 and the rear area 138, at the sole area 130, and at the heel area 132 of the club head 520. The twelfth weight 512 may be located generally midway between the front area 136 and the rear area 138, at the crown area 128, and at the heel area 132 of the club head 520. The thirteenth weight 513 may be located generally at the rear area 138, midway between the sole area 130 and the crown area 128 (or, optionally, more toward the sole area 130), and midway between the toe area 134 and the heel area 132 of the club head 520.

Additionally, as shown in FIG. 5, the plurality of tubes 515 connect each of the plurality of weights 501-513. For example, one of the plurality of tubes 515 may connect the first weight 501 and the second weight 502. Another one of the plurality of tubes 515 may connect the first weight 501 and the third weight 503. Another one of the plurality of tubes 515 may connect the second weight 502 and the fourth weight 504. Another one of the plurality of tubes 515 may connect the third weight 503 and the fourth weight 504. Each of these tubes that connect the first weight 501, the second weight 502, the third weight 503, the fourth weight 504, the fifth weight 505, and the sixth weight 506, may be engaged with the striking face 126.

Additionally, as illustrated in FIG. 5, another one of the plurality of tubes 515 may connect the first weight 501 and the fifth weight 505. Another one of a plurality of tubes 515 may connect the first weight 501 and the seventh weight 507. Another one of the plurality of tubes 515 may connect the second weight 502 and the sixth weight 506. Another one of the plurality of tubes 515 may connect the second weight 102 and the eighth weight 508. Another one of the plurality of tubes 515 may connect the third weight 503 and the fifth weight 505. Another one of the plurality of tubes 515 may connect the third weight 503 and the eleventh weight 511. Another one of the plurality of tubes 515 may connect the fourth weight 504 and the sixth weight 506. Another one of the plurality of tubes 515 may connect the fourth weight 504 and the twelfth weight 512. Another one of the plurality of tubes 515 may connect the fifth weight 505 and the sixth weight 506. Another one of the plurality of tubes 515 may connect the fifth weight 505 and the ninth weight 509. Another one of the plurality of tubes 515 may connect the sixth weight 506 and the tenth weight 510. Another one of the plurality of tubes 515 may connect the seventh weight 507 and the eighth weight 508. Another one of the plurality of tubes 515 may connect the seventh weight 507 and the thirteenth weight 513. Another one of the plurality of tubes 515 may connect the eighth weight 508 and the thirteenth weight 513. Another one of the plurality of tubes 515 may connect the ninth weight 509 and the tenth weight 510. Another one of the plurality of tubes 515 may connect the eleventh weight 511 and the twelfth weight 512. Another one of the plurality of tubes 515 may connect the eleventh weight 511 and the thirteenth weight 513. Another one of the plurality of tubes 515 may connect the twelfth weight 512 and the thirteenth weight 513.

Figure 6:
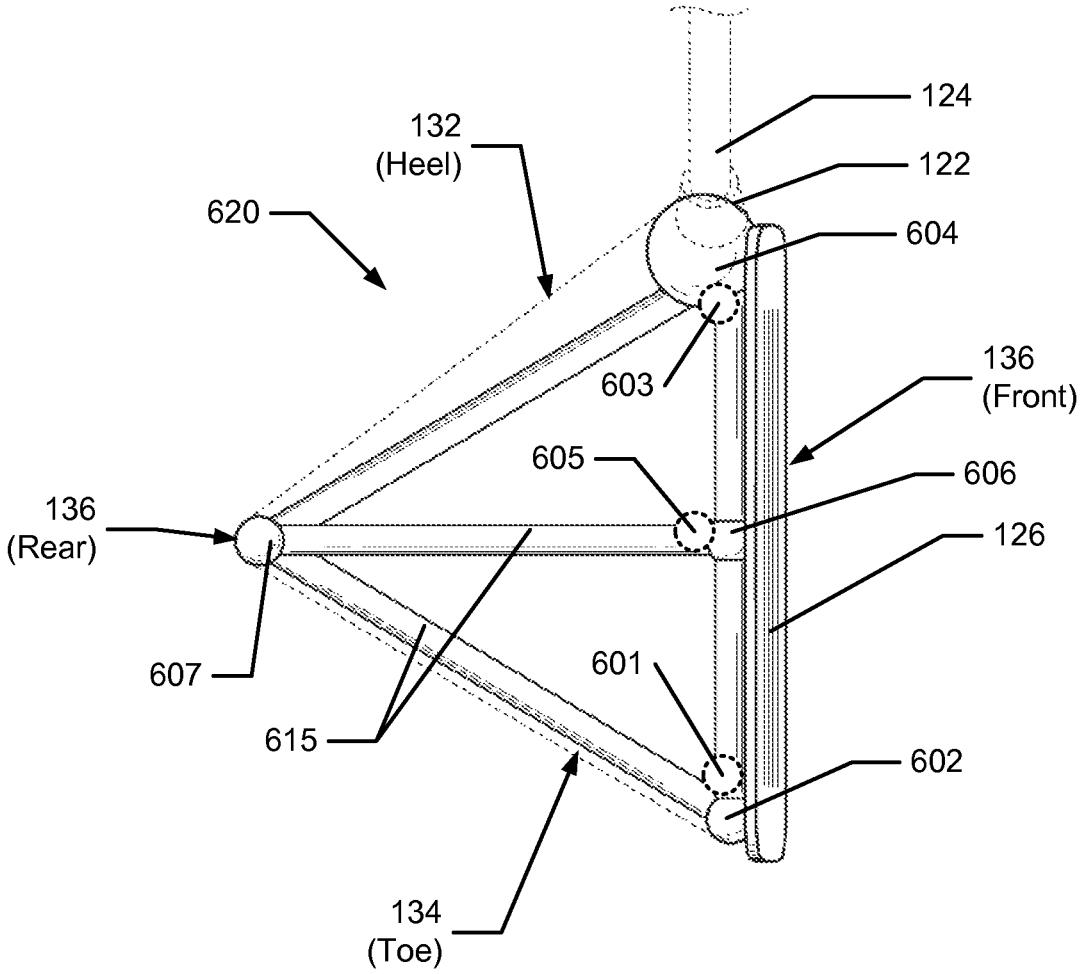

In another example in accordance with this invention, the wood-type golf club head 620 shown in FIG. 6 includes many features in common with the golf club head 120 shown in FIGS. 2A through 3B and described above, and common reference numerals are used to describe such common features.

Specifically, as illustrated in FIG. 6, the first weight 601 may be located generally at the front area 136, the sole area 130, and the toe area 134 of the club head 620. The second weight 602 may be located generally at the front area 136, the crown area 128, and the toe area 134 of the club head 620. The third weight 603 may be located generally at the front area 136, the sole area 130, and the heel area 132 of the club head 620. The fourth weight 604 may be located generally at the front area 136, the crown area 128, and the heel area 132 of the club head 620. Additionally, if desired, the fourth weight 604 may form at least a portion of the hosel 122. The fifth weight 605 may be located generally at the front area 136, at the sole area 130, and midway between the toe area 134 and the heel area 132 of the club head 620. The sixth weight 606 may be located generally at the front area 136, at the crown area 128, and midway between the toe area 134 and the heel area 132 of the club head 620. Each of these weights, the first weight 601, the second weight 602, the third weight 603, the fourth weight 604, the fifth weight 605, and the sixth weight 606 may be engaged with the striking face 126.

As further illustrated in FIG. 6, the seventh weight 607 may be located generally at the rear area 138, midway between the sole area 130 and the crown area 128 (or, optionally, more toward the sole area 130), and midway between the toe area 134 and the heel area 132 of the club head 620.

Additionally, as shown in FIG. 6, the plurality of tubes 615 connect each of the plurality of weights 601-607. For example, one of the plurality of tubes 615 may connect the first weight 601 and the second weight 602. Another one of the plurality of tubes 615 may connect the first weight 601 and the third weight 603. Another one of the plurality of tubes 615 may connect the second weight 602 and the fourth weight 604. Another one of the plurality of tubes 615 may connect the third weight 603 and the fourth weight 604. Each of these tubes mentioned above, connecting the first weight 601, the second weight 602, the third weight 603, and the fourth weight 604, may be engaged with the striking face 126.

Additionally, as further shown in FIG. 6, another one of the plurality of tubes 615 may connect the first weight 601 and the fifth weight 605. Another one of a plurality of tubes 615 may connect the first weight 601 and the seventh weight 607. Another one of the plurality of tubes 615 may connect the second weight 602 and the sixth weight 606. Another one of the plurality of tubes 615 may connect the second weight 602 and the seventh weight 607. Another one of the plurality of tubes 615 may connect the third weight 603 and the fifth weight 605. Another one of the plurality of tubes 615 may connect the third weight 603 and the seventh weight 607. Another one of the plurality of tubes 615 may connect the fourth weight 604 and the sixth weight 606. Another one of the plurality of tubes 615 may connect the fourth weight 604 and the seventh weight 607. Another one of the plurality of tubes 615 may connect the fifth weight 605 and the sixth weight 606. Another one of the plurality of tubes 615 may connect the fifth weight 605 and the seventh weight 607. Another one of the plurality of tubes 615 may connect the sixth weight 606 and the seventh weight 607.

Figure 7:
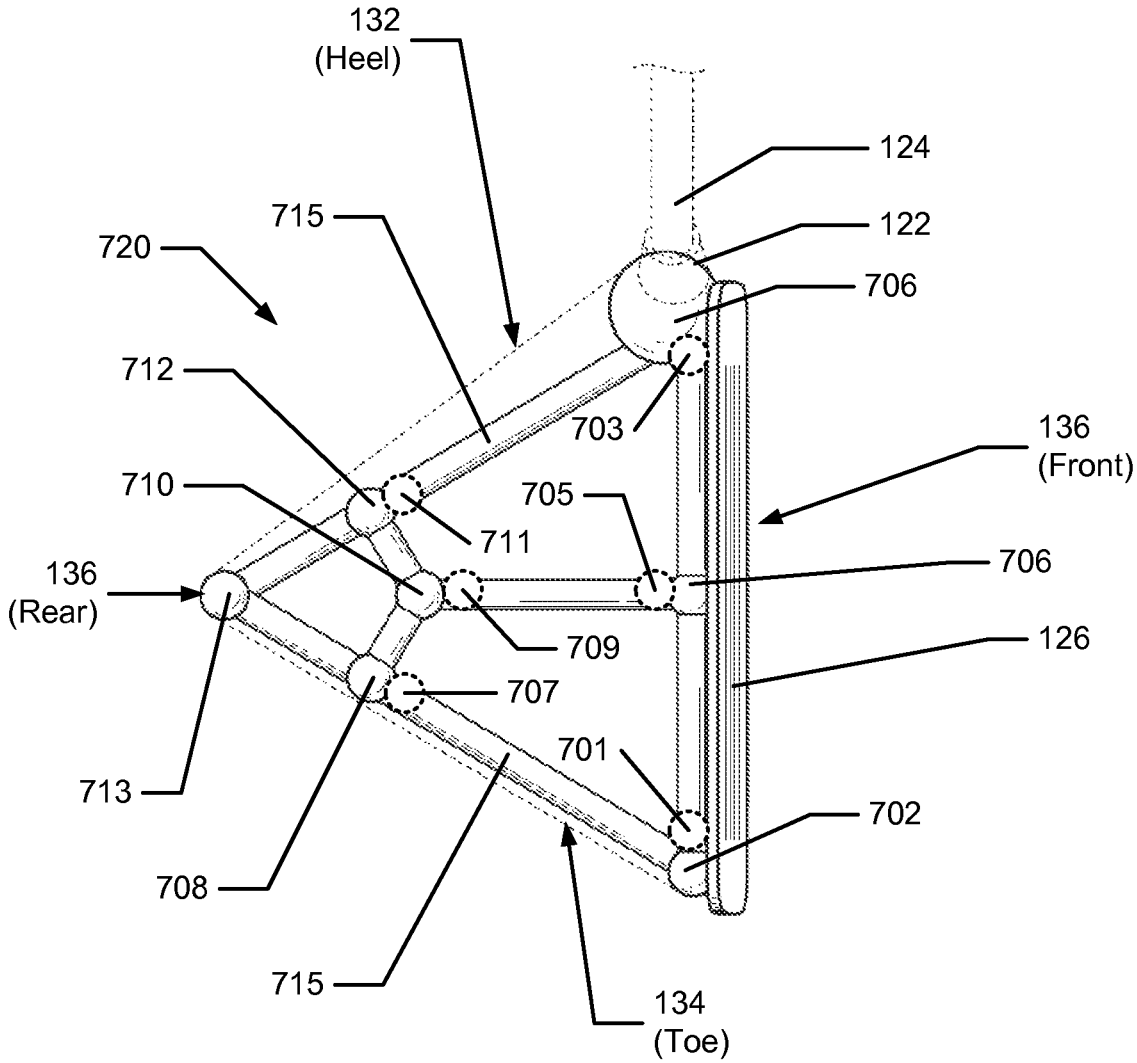

In another example in accordance with this invention, the wood-type golf club head 720 shown in FIG. 7 includes many features in common with the golf club head 120 shown in FIGS. 2A through 3B and described above, and common reference numerals are used to describe such common features.

Specifically, as illustrated in FIG. 7, the first weight 701 may be located generally at the front area 136, the sole area 130, and the toe area 134 of the club head 720. The second weight 702 may be located generally at the front area 136, the crown area 128, and the toe area 134 of the club head 720. The third weight 703 may be located generally at the front area 136, the sole area 130, and the heel area 132 of the club head 720. The fourth weight 704 may be located generally at the front area 136, the crown area 128, and the heel area 132 of the club head 720. Additionally, if desired, the fourth weight 704 may form at least a portion of the hosel 122. The fifth weight 705 may be located generally at the front area 136, at the sole area 130, and midway between the toe area 134 and the heel area 132 of the club head 720. The sixth weight 706 may be located generally at the front area 136, at the crown area 128, and midway between the toe area 134 and the heel area 132 of the club head 720. Each of these weights, the first weight 701, the second weight 702, the third weight 703, the fourth weight 704, the fifth weight 705, and the sixth weight 706 may be engaged with the striking face 126.

As further illustrated in FIG. 7, the seventh weight 707 may be located generally near the rear 138, at the sole 130, and near the midway point of the toe area 134 and the heel area 132 on the toe side of the club head 720. The eighth weight 708 may be located generally midway near the rear 138, at the crown 128, and near the midway point of the toe area 134 and the heel area 132 on the toe side of the club head 720. The ninth weight 709 may be located generally near the rear 138, at the sole 130, and midway between the toe area 134 and the heel area 132 of the club head 720. The tenth weight 710 may be located generally near the rear 138, at the sole 130, and midway between the toe area 134 and the heel area 132 of the club head 720. The eleventh weight 711 may be located generally near the rear area 138, at the sole area 130, and near the midway point of the toe area 134 and the heel area 132 on the heel side of the club head 720. The twelfth weight 712 may be located generally near the rear area 138, at the crown area 128, and near the midway point of the toe area 134 and the heel area 132 on the heel side of the club head 720. The thirteenth weight 713 may be located generally at the rear area 138, midway between the sole area 130 and the crown area 128 (or, optionally, more toward the sole area 130), and midway between the toe area 134 and the heel area 132 of the club head 720.

Additionally, as shown in FIG. 7, the plurality of tubes 715 connect each of the plurality of weights 701-713. For example, one of the plurality of tubes 715 may connect the first weight 701 and the second weight 702. Another one of the plurality of tubes 715 may connect the first weight 701 and the third weight 703. Another one of the plurality of tubes 715 may connect the second weight 702 and the fourth weight 704. Another one of the plurality of tubes 715 may connect the third weight 703 and the fourth weight 704. Each of these tubes that connect the first weight 701, the second weight 702, the third weight 703, and the fourth weight 704, may be engaged with the striking face 126.

As further shown in FIG. 7, another one of the plurality of tubes 715 may connect the first weight 701 and the fifth weight 705. Another one of a plurality of tubes 715 may connect the first weight 701 and the seventh weight 707. Another one of the plurality of tubes 715 may connect the second weight 702 and the sixth weight 706. Another one of the plurality of tubes 715 may connect the second weight 702 and the eighth weight 708. Another one of the plurality of tubes 715 may connect the third weight 703 and the fifth weight 705. Another one of the plurality of tubes 715 may connect the third weight 103 and the eleventh weight 711. Another one of the plurality of tubes 715 may connect the fourth weight 704 and the sixth weight 706. Another one of the plurality of tubes 715 may connect the fourth weight 704 and the twelfth weight 712. Another one of the plurality of tubes 715 may connect the fifth weight 705 and the sixth weight 706. Another one of the plurality of tubes 715 may connect the fifth weight 705 and the sixth weight 706. Another one of the plurality of tubes 715 may connect the fifth weight 705 and the ninth weight 709. Another one of the plurality of tubes 715 may connect the sixth weight 706 and the tenth weight 710. Another one of the plurality of tubes 715 may connect the seventh weight 707 and the eighth weight 708. Another one of the plurality of tubes 715 may connect the seventh weight 707 and the thirteenth weight 714. Another one of the plurality of tubes 715 may connect the eighth weight 708 and the thirteenth weight 713. Another one of the plurality of tubes 715 may connect the ninth weight 709 and the tenth weight 710. Another one of the plurality of tubes 715 may connect the eleventh weight 711 and the twelfth weight 712. Another one of the plurality of tubes 715 may connect the eleventh weight 711 and the thirteenth weight 713. Another one of the plurality of tubes 715 may connect the twelfth weight 712 and the thirteenth weight 713.

Figure 8A:
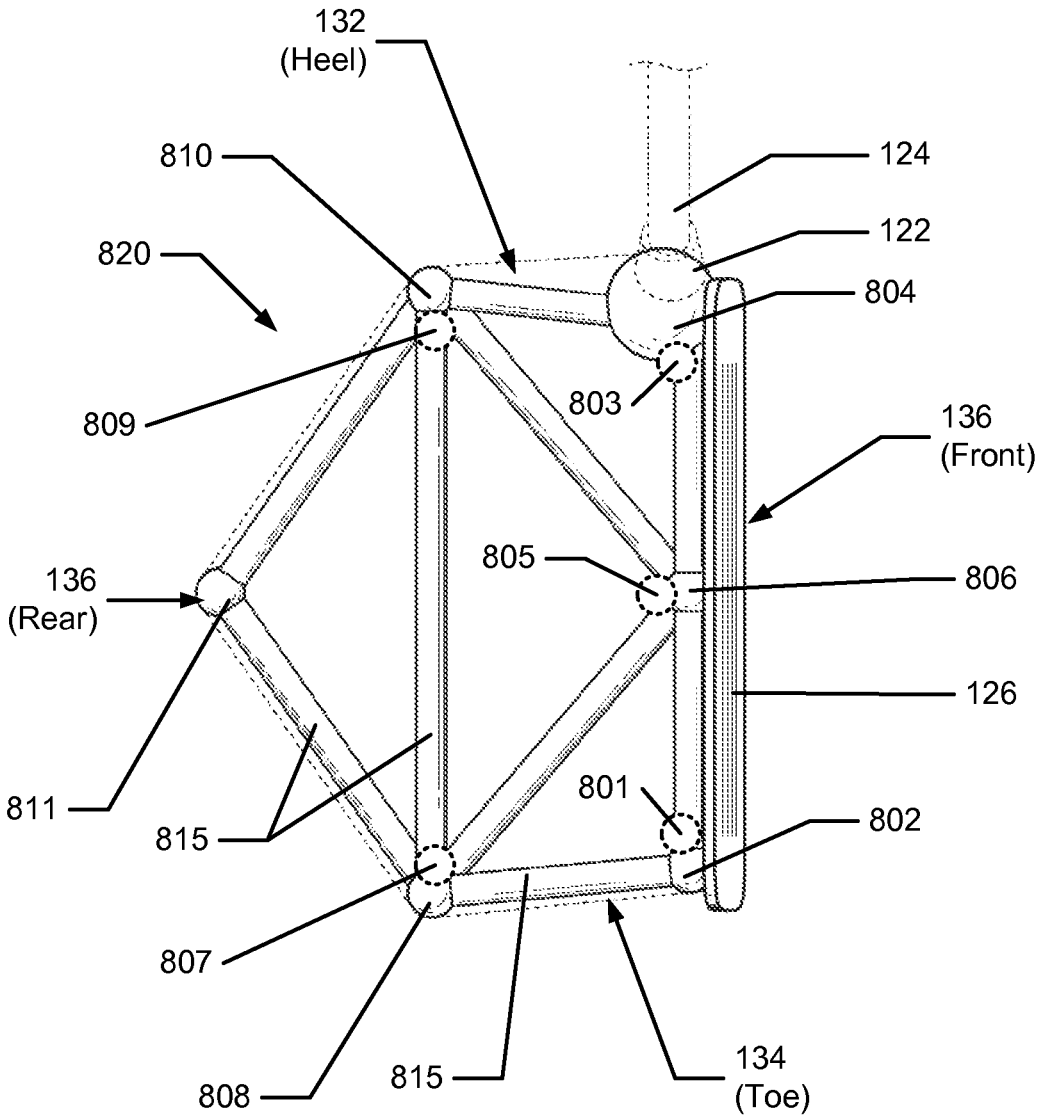

In another example golf club head in accordance with this invention, the wood-type golf club head 820 shown in FIG. 8A includes many features in common with the golf club head 120 shown in FIGS. 2A through 3B and described above, and common reference numerals are used to describe such common features.

Specifically, as illustrated in FIG. 8A, the first weight 801 may be located generally at the front area 136, the sole area 130, and the toe area 134 of the club head 820. The second weight 802 may be located generally at the front area 136, the crown area 128, and the toe area 134 of the club head 820. The third weight 803 may be located generally at the front area 136, the sole area 130, and the heel area 132 of the club head 820. The fourth weight 804 may be located generally at the front area 136, the crown area 128, and the heel area 132 of the club head 820. Additionally, if desired, the fourth weight 104 may form at least a portion of the hosel 122. The fifth weight 805 may be located generally at the front area 136, at the sole area 130, and midway between the toe area 134 and the heel area of the club head 820. The sixth weight 806 may be located generally at the front area 136, at the crown area 128, and midway between the toe area 134 and the heel area of the club head 820. Each of these weights, the first weight 801, the second weight 802, the third weight 803, the fourth weight 804, the fifth weight 805, and the sixth weight 806 may be engaged with the striking face 126.

As further illustrated in FIG. 8A, the seventh weight 807 may be located generally midway between the front area 136 and the rear area 138, at the sole area 130, and at the toe area 134 of the club head 820. The eighth weight 808 may be located generally midway between the front area 136 and the rear area 138, at the crown area 128, and at the toe area 134 of the club head 820. The ninth weight 809 may be located generally midway between the front area 136 and the rear area 138, at the sole area 130, and at the heel area 132 of the club head 820. The tenth weight 810 may be located generally midway between the front area 136 and the rear area 138, at the crown area 128, and at the heel area 132 of the club head

820. The eleventh weight 811 may be located generally at the rear area 138, midway between the sole area 130 and the crown area 128 (or, optionally, more toward the sole area 130), and midway between the toe area 134 and at the heel area 132 of the club head 820.

Additionally, as shown in FIG. 8A, the plurality of tubes 815 connect each of the plurality of weights 801-811. For example, one of the plurality of tubes 815 may connect the first weight 801 and the second weight 802. Another one of the plurality of tubes 815 may connect the first weight 801 and the third weight 803. Another one of the plurality of tubes 815 may connect the second weight 802 and the fourth weight 804. Another one of the plurality of tubes 815 may connect the third weight 803 and the fourth weight 804. Each of these tubes mentioned above, connecting the first weight 801, the second weight 802, the third weight 803, and the fourth weight 804, may be engaged with the striking face 126.

Additionally, another one of the plurality of tubes 815 may connect the first weight 801 and the fifth weight 805. Another one of a plurality of tubes 815 may connect the first weight 801 and the seventh weight 807. Another one of the plurality of tubes 815 may connect the second weight 802 and the sixth weight 806. Another one of the plurality of tubes 815 may connect the second weight 802 and the eighth weight 808. Another one of the plurality of tubes 815 may connect the third weight 803 and the fifth weight 805. Another one of the plurality of tubes 815 may connect the third weight 803 and the ninth weight 809. Another one of the plurality of tubes 815 may connect the fourth weight 804 and the sixth weight 806. Another one of the plurality of tubes 815 may connect the fourth weight 804 and the ninth weight 809. Another one of the plurality of tubes 815 may connect the fifth weight 805 and the sixth weight 806. Another one of the plurality of tubes 815 may connect the fifth weight 805 and the seventh weight 807. Another one of the plurality of tubes 815 may connect the fifth weight 805 and the ninth weight 809. Another one of the plurality of tubes 815 may connect the sixth weight 806 and the eighth weight 808. Another one of the plurality of tubes 815 may connect the sixth weight 806 and the tenth weight 810. Another one of the plurality of tubes 815 may connect the seventh weight 807 and the eighth weight 808. Another one of the plurality of tubes 815 may connect the seventh weight 807 and the ninth weight 809. Another one of the plurality of tube 815 may connect the seventh weight 807 and the eleventh weight 811. Another one of the plurality of tubes 815 may connect the eighth weight 808 and the tenth weight 810. Another one of the plurality of tubes 815 may connect the eighth weight 808 and the eleventh weight 811. Another one of the plurality of tubes 815 may connect the ninth weight 809 and the tenth weight 810. Another one of the plurality of tubes 815 may connect the ninth weight 811 and the eleventh weight 811. Another one of the plurality of tubes 815 may connect the tenth weight 810 and the eleventh weight 811.

Figure 8B:
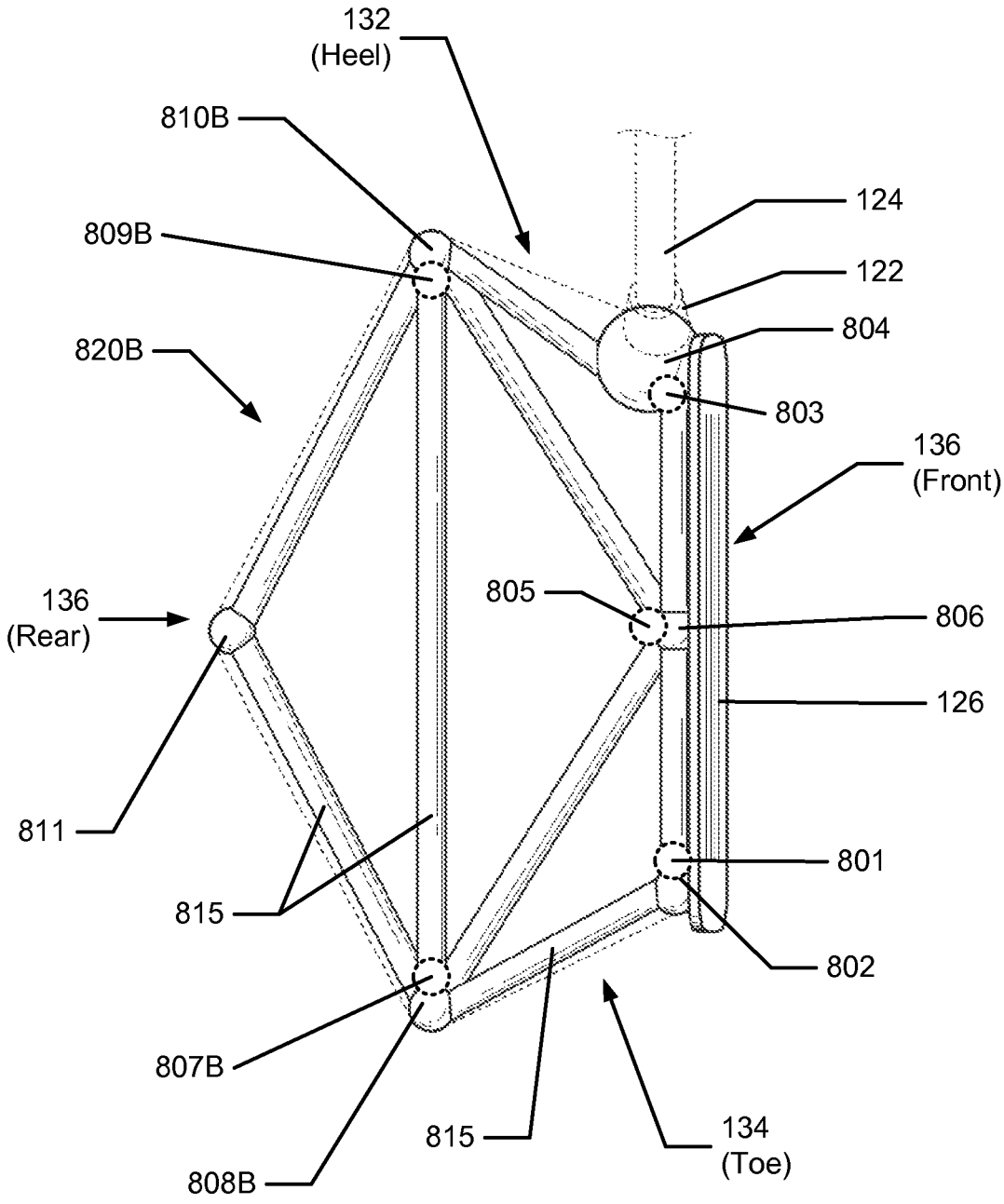

FIG. 8B illustrates another example golf club head in accordance with this invention. The wood-type golf club head 820B shown in FIG. 8B includes many features in common with the golf club head 820 shown in FIG. 8A and described above, and common reference numerals are used to describe such common features.

FIG. 8B illustrates a golf club head 820B that has a plurality of the weights extended outward in the direction of the heel 132 and the toe 134. For example, the seventh weight 807B and the eighth weight 808B may be extended outward in the direction of the toe 134. The seventh weight 807B and the eighth weight 808B may be extended outward so that it extends outside the area defined by the ball striking face 126. Additionally, the ninth weight 809B and the tenth weight 810B may be extended outward in the direction of the heel 132. The ninth weight 809B and the tenth weight 810B may be extended outward so that it extends outside the area defined by the ball striking face 126. By moving these weights outside the area defined by the ball striking face 126, the effective impact area on the ball striking face 126 may be increased such that off-center hits on a golf ball may not be affected as much as in the other configuration. Additionally, those of skill in the art will recognize that this is merely one example of how the weights may be moved outside the ball striking face area 126. There may be many other configurations of weights and tubing that can be utilized to move the weights outside the ball striking face area 126.

Figure 9A:
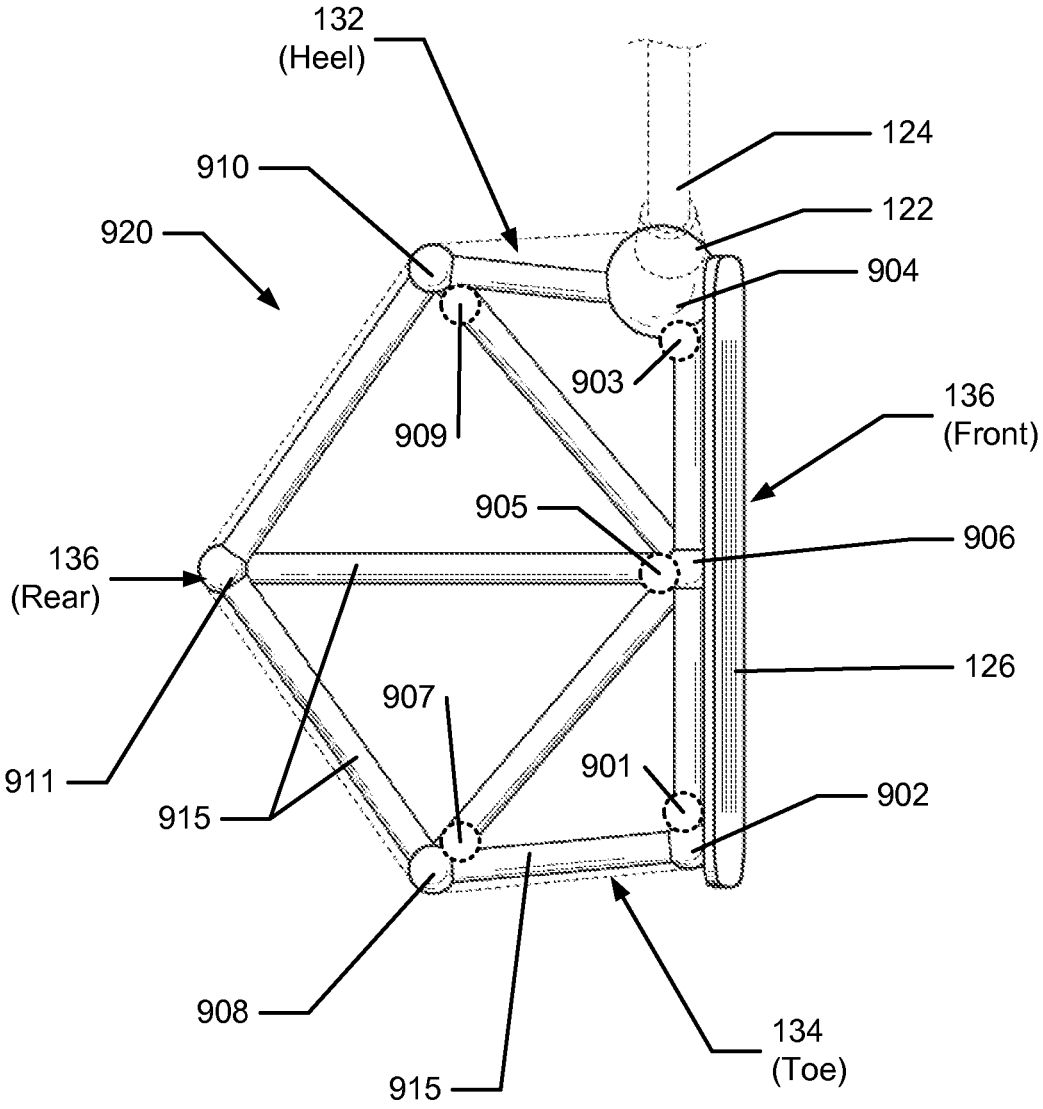

In another example club head in accordance with this invention, the wood-type golf club head 920 shown in FIG. 9A includes many features in common with the golf club head 120 shown in FIGS. 2A through 3B and described above, and common reference numerals are used to describe such common features.

Specifically, as illustrated in FIG. 9A, the first weight 901 may be located generally at the front area 136, the sole area 130, and the toe area 134 of the club head 920. The second weight 902 may be located generally at the front area 136, the crown area 128, and the toe area 134 of the club head 920. The third weight 903 may be located generally at the front area 136, the sole area 130, and the heel area 132 of the club head 920. The fourth weight 904 may be located generally at the front area 136, the crown area 128, and the heel area 132 of the club head 920. Additionally, if desired, the fourth weight 904 may form at least a portion of the hosel 122. The fifth weight 905 may be located generally at the front area 136, at the sole area 130, and midway between the toe area 134 and the heel area 132 of the club head 920. The sixth weight 906 may be located generally at the front area 136, at the crown area 128, and midway between the toe area 134 and the heel area 132 of the club head 920. Each of these weights, the first weight 901, the second weight 902, the third weight 903, the fourth weight 904, the fifth weight 905, and the sixth weight 906 may be engaged with the striking face 126.

As further illustrated in FIG. 9A, the seventh weight 907 may be located generally midway between the front area 136 and the rear area 138, the sole 130, and the toe 134 of the club head 920. The eighth weight 908 may be located generally midway between the front area 136 and the rear area 138, at the crown area 128, and at the toe area 134 of the club head 920. The ninth weight 909 may be located generally midway between the front area 136 and the rear area 138, at the sole 130, and at the heel of the club head 920. The tenth weights may be located generally midway between the front area 136 and the rear area 138, at the crown area 128, and at the heel area 132 of the club head 920. The eleventh weight 911 may be located at the rear area 138, midway between the sole area 130 and the crown area 128 (or, optionally, more toward the sole area 130), and midway between the toe area 134 and the heel area 132 of the club head 920.

Additionally, as shown in FIG. 9A, the plurality of tubes 915 connect each of the plurality of weights 901-911. For example, one of the plurality of tubes 915 may connect the first weight 901 and the second weight 902. Another one of the plurality of tubes 915 may connect the first weight 901 and the third weight 903. Another one of the plurality of tubes 815 may connect the second weight 902 and the fourth weight 904. Another one of the plurality of tubes 915 may connect the third weight 903 and the fourth weight 904. Each of these tubes mentioned above, connecting the first weight 901, the second weight 902, the third weight 903, and the fourth weight 904, may be engaged with the striking face 126.

Additionally, another one of the plurality of tubes 915 may connect the first weight 901 and the fifth weight 905. Another one of a plurality of tubes 915 may connect the first weight 901 and the seventh weight 907. Another one of the plurality of tubes 915 may connect the second weight 902 and the sixth weight 906. Another one of the plurality of tubes 915 may connect the second weight 902 and the eighth weight 908. Another one of the plurality of tubes 915 may connect the third weight 903 and the fifth weight 905. Another one of the plurality of tubes 915 may connect the third weight 903 and the ninth weight 909. Another one of the plurality of tubes 915 may connect the fourth weight 904 and the sixth weight 906. Another one of the plurality of tubes 915 may connect the fourth weight 904 and the ninth weight 909. Another one of the plurality of tubes 915 may connect the fifth weight 905 and the sixth weight 906. Another one of the plurality of tubes 915 may connect the fifth weight 905 and the seventh weight 907. Another one of the plurality of tubes 915 may connect the fifth weight 905 and the ninth weight 909. Another one of the plurality of tubes 915 may connect the sixth weight 906 and the eighth weight 908. Another one of the plurality of tubes 915 may connect the sixth weight 906 and the tenth weight 910. Another one of the plurality of tubes 915 may connect the sixth weight 906 and the eleventh weight 911. Another one of the plurality of tubes 915 may connect the seventh weight 907 and the eighth weight 908. Another one of the plurality of tubes 915 may connect the seventh weight 907 and the eleventh weight 911. Another one of the plurality of tubes 915 may connect the eighth weight 908 and the eleventh weight 911. Another one of the plurality of tubes 915 may connect the ninth weight 909 and the tenth weight 910. Another one of the plurality of tubes 915 may connect the ninth weight 911 and the eleventh weight 911. Another one of the plurality of tubes 915 may connect the tenth weight 910 and the eleventh weight 911.

Figure 9B:
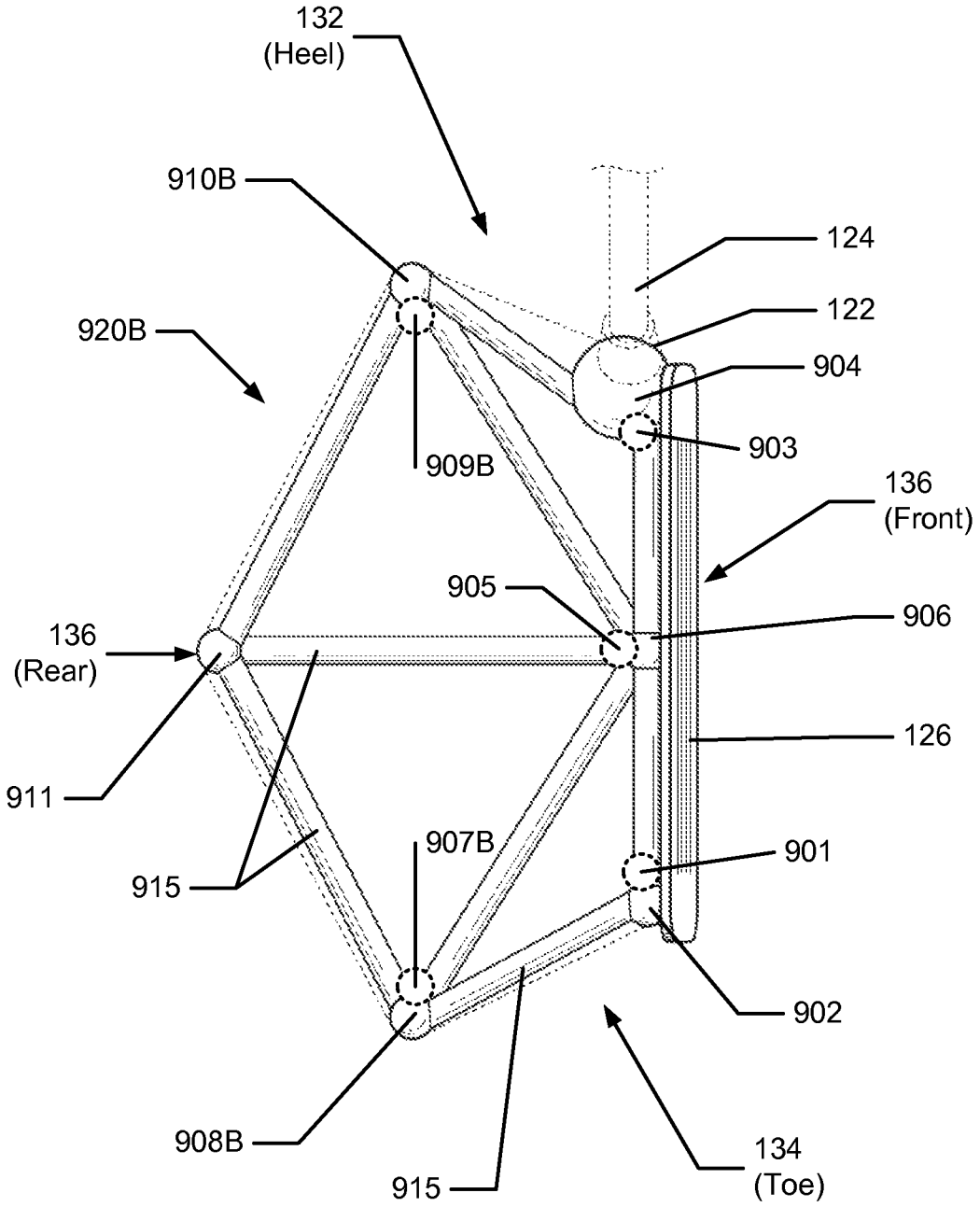

FIG. 9B illustrates another example golf club head in accordance with this invention, similar to the golf club head illustrated in FIG. 8B. The wood-type golf club head 920B shown in FIG. 9B includes many features in common with the golf club head 920 shown in FIG. 9A and described above, and common reference numerals are used to describe such common features.

FIG. 9B illustrates a golf club head 920B that has a plurality of the weights extended outward in the direction of the heel 132 and the toe 134. For example, the seventh weight 907B and the eighth weight 908B may be extended outward in the direction of the toe 134. The seventh weight 907B and the eighth weight 908B may be extended outward so that it extends outside the area defined by the ball striking face 126. Additionally, the ninth weight 909B and the tenth weight 910B may be extended outward in the direction of the heel 132. The ninth weight 909B and the tenth weight 910B may be extended outward so that it extends outside the area defined by the ball striking face 126. By moving these weights outside the area defined by the ball striking face 126, the effective impact area on the ball striking face 126 may be increased such that off-center hits on a golf ball may not be affected as much as in the other configuration. Additionally, those of skill in the art will recognize that this is merely one example of how the weights may be moved outside the ball striking face area 126. There may be many other configurations of weights and tubing that can be utilized to move the weights outside the ball striking face area 126.

Figure 10A:
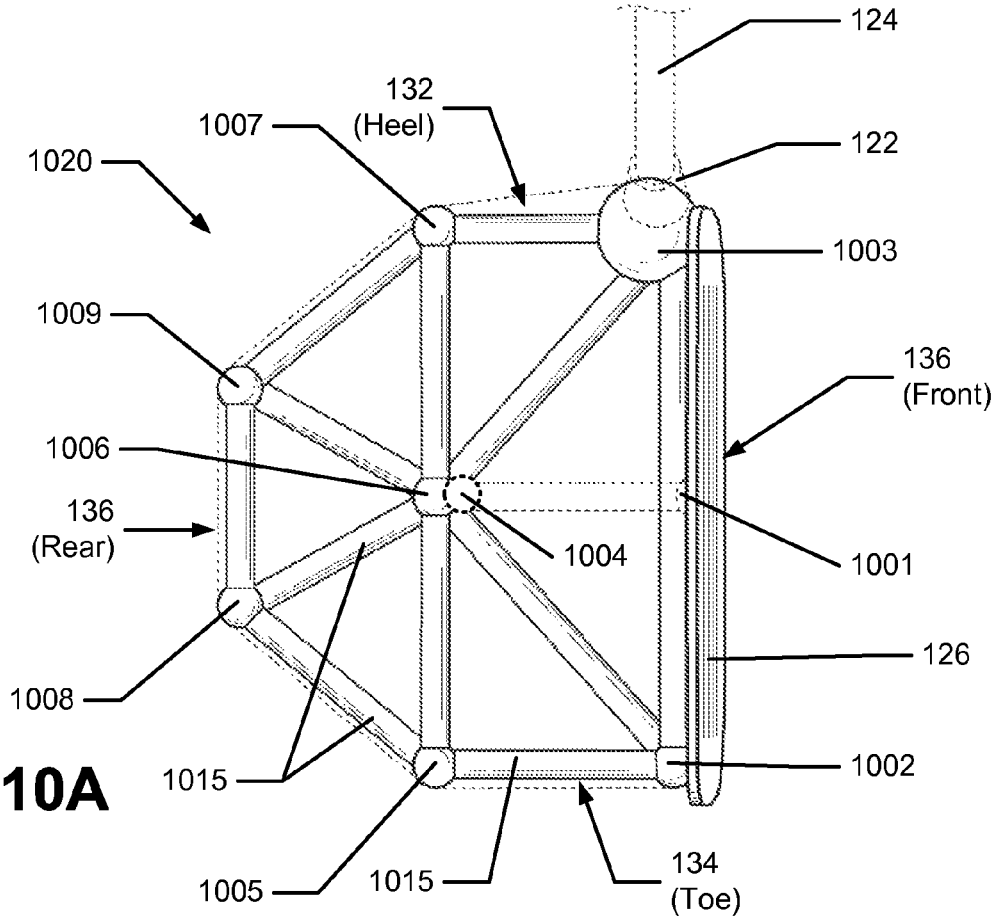
Figure 10B:
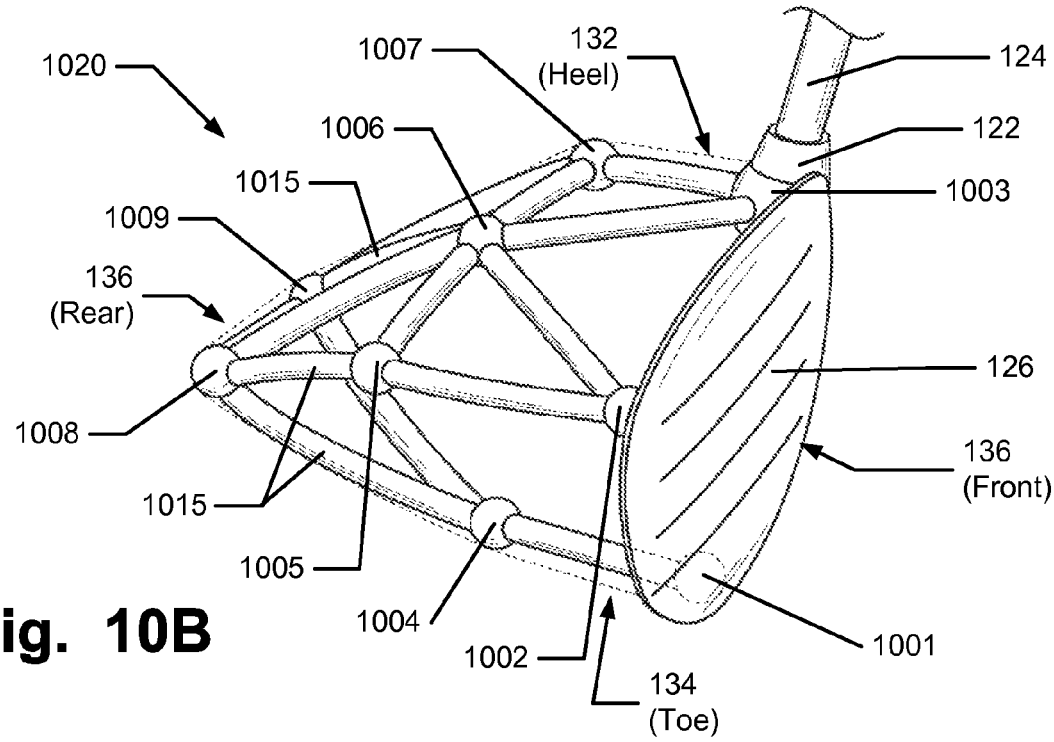
FIG. 10B illustrates an internal front perspective view of the wood-type golf club head of FIG. 10A.

In another example club head in accordance with this invention, the wood-type golf club head 1020 shown in FIGS. 10A and 10B includes many features in common with the golf club head 120 shown in FIGS. 2A through 3B and described above, and common reference numerals are used to describe such common features.

Specifically, as illustrated in FIGS. 10A and 10B, the first weight 1001 may be located generally at the front area 136, the sole area 130, and midway between the heel area 132 and the toe area 134 of the club head 1020. The second weight 1002 may be located generally at the front area 136, the crown area 128, and the toe area 134 of the club head 1020. The third weight 1003 may be located generally at the front area 136, the crown area 128, and the heel area 132 of the club head 1020. Additionally, if desired, the third weight 1003 may form at least a portion of the hosel 122. Each of these weights, the first weight 1001, the second weight 1002, and the third weight 1003, may be engaged with the striking face 126.

As further illustrated in FIGS. 10A and 10B, the fourth weight 1004 may be located generally midway between the front area 136 and the rear area 138, the sole 130, and generally midway between the heel 132 and the toe 134 of the club head 1020. The fifth weight 1005 may be located generally midway between the front area 136 and the rear area 138, at the crown area 128, and at the toe area 134 of the club head 1020. The sixth weight 1006 may be located generally midway between the front area 136 and the rear area 138, at the crown area 128 and generally midway between the heel 132 and the toe 134 of the club head 1020. The seventh weight 1007 may be located generally midway between the front area 136 and the rear area 138, at the crown area 128, and at the toe area 134 of the club head 1020. The eighth weight 1008 may be located at the rear area 138, midway between the sole area 130 and the crown area 128 (or, optionally, more toward the sole area 130), and generally midway between the toe area 134 and the heel area 132 and closer to the toe area 134 of the club head 1020. The ninth weight 1009 may be located at the rear area 138, midway between the sole area 130 and the crown area 128 (or, optionally, more toward the sole area 130), and generally midway between the toe area 134 and the heel area 132 and closer to the heel area 132 of the club head 1020.

Additionally, as shown in FIGS. 10A and 10B, the plurality of tubes 1015 connect each of the plurality of weights 1001-1009. For example, one of the plurality of tubes 1015 may connect the first weight 1001 and the second weight 1002. Another one of the plurality of tubes 1015 may connect the first weight 1001 and the third weight 1003. Another one of the plurality of tubes 1015 may connect the second weight 1002 and the third weight 1003. Each of these tubes mentioned above, connecting the first weight 1001, the second weight 1002, and the third weight 1003, may be engaged with the striking face 126.

Additionally, another one of the plurality of tubes 1015 may connect the first weight 1001 and the fourth weight 1005. Another one of a plurality of tubes 1015 may connect the second weight 1002 and the fifth weight 1005. Another one of the plurality of tubes 1015 may connect the second weight 1002 and the sixth weight 1006. Another one of the plurality of tubes 1015 may connect the third weight 1003 and the sixth weight 1006. Another one of the plurality of tubes 1015 may connect the third weight 1003 and the seventh weight 1007. Another one of the plurality of tubes 1015 may connect the fourth weight 1004 and the fifth weight 1005. Another one of the plurality of tubes 1015 may connect the fourth weight 1004 and the seventh weight 1007. Another one of the plurality of tubes 1015 may connect the fourth weight 1004 and the eighth weight 1008. Another one of the plurality of tubes 1015 may connect the fourth weight 1004 and the ninth weight 1009. Another one of the plurality of tubes 1015 may connect the fifth weight 1005 and the sixth weight 1006. Another one of the plurality of tubes 1015 may connect the fifth weight 1005 and the ninth weight 1009. Another one of the plurality of tubes 1015 may connect the sixth weight 1006 and the seventh weight 1007. Another one of the plurality of tubes 1015 may connect the sixth weight 1006 and the eighth weight 1008. Another one of the plurality of tubes 1015 may connect the sixth weight 1006 and the ninth weight 1009. Another one of the plurality of tubes 1015 may connect the seventh weight 1007 and the eighth weight 1008. Another one of the plurality of tubes 1015 may connect the eighth weight 1008 and the ninth weight 1009.

Weighting characteristics can be important to providing a wood-type golf club head with desired user feel and swing characteristics, such as overall weight, moment of inertia, etc. By varying the location and mass of the plurality of weights and making some or all of the plurality of weights and/or the plurality of tubes from titanium metal and/or titanium based alloys, a relatively strong and lightweight club head structure can be provided (other lightweight materials also may be used without departing from this invention, such as aluminum, aluminum alloys, magnesium, magnesium alloys, polymeric materials, reinforced carbon fiber materials, reinforced basalt fiber materials, etc.). Making the plurality of weights and the plurality of tubes from lightweight materials allows club designers to selectively place additional weight at desired locations in the club head structure without creating an excessively heavy golf club structure, which can lead to increased club head moment of inertia characteristics, selective club head biasing characteristics (to bias the club head to produce a right-to-left ball flight, a left-to-right ball flight, a lower trajectory, a higher trajectory, etc.), and the like. Such features also allow club head designers and club fitters to selectively place weight in the club head so as to help compensate for user swing flaws (e.g., to "draw" or "hook" bias a club head to help compensate for swing flaws that produce a slice, to "fade" or "slice" bias a club head to help compensate for swing flaws that produce a hook, etc.).

Figure 11:
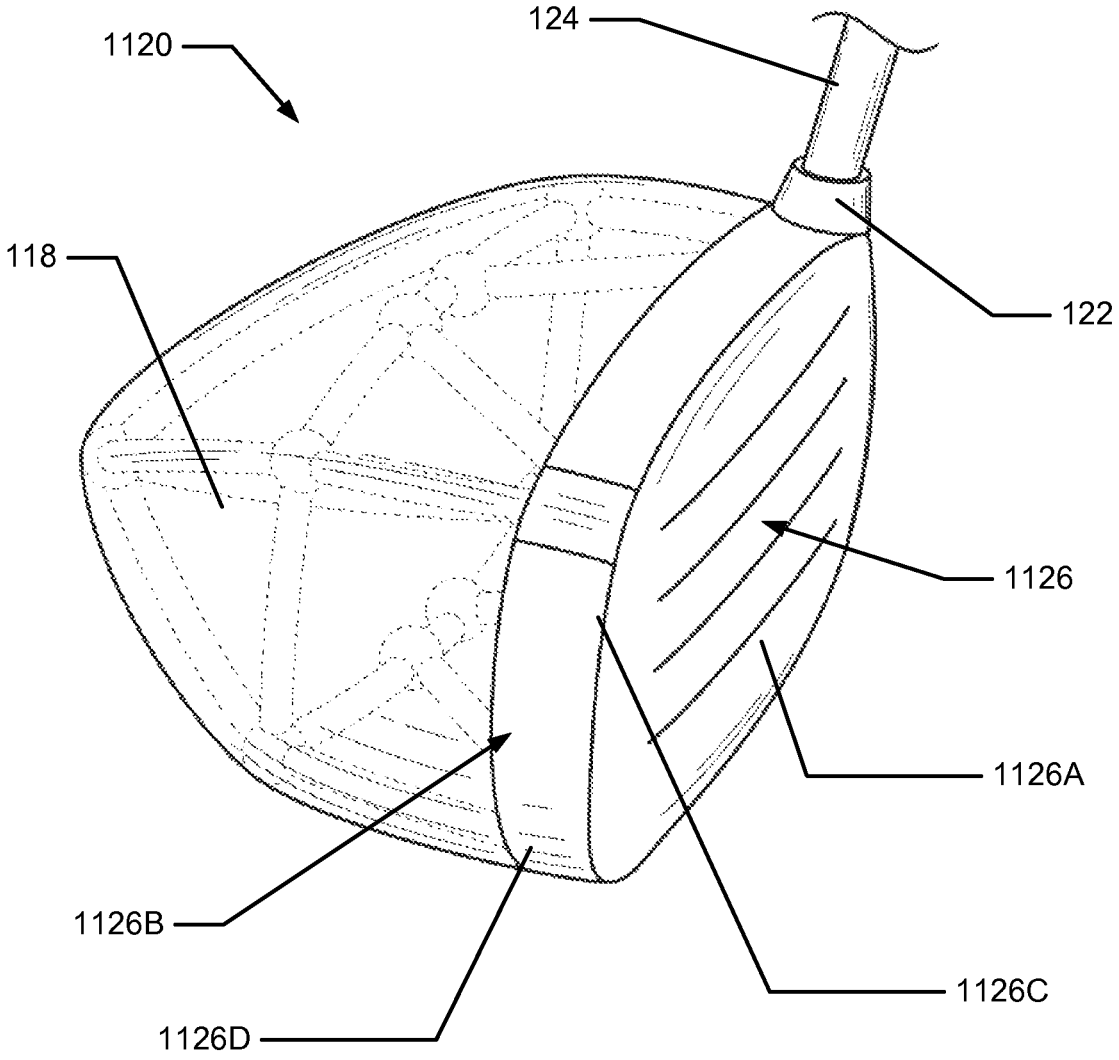
FIG. 11 illustrates an internal front perspective view of another wood-type golf club head in accordance with examples of this invention.

As illustrated in FIG. 11, in addition to the features as described above, the ball striking face may include a cup face assembly 1126 in accordance with some examples of this invention. The cup face assembly 1126 may be composed of a striking plate 1126A and a face component 1126B, which may be joined together to form the face cup assembly 1126. The face component 1126B may generally include a striking wall portion 1126C and a return portion 1126D that extends laterally rearward from the perimeter of the striking wall portion 1126C. The face component 1126B may also include a striking plate recess (not illustrated) formed in the hitting surface of the striking wall portion 1126C, where the hitting surface is defined as the surface that faces a golf ball during a golf swing.

As shown in FIG. 11, the cup face assembly 1126 may be formed by bonding the striking plate 1126A to the face component 1126B using a bonding method such as adhesive, welding, or brazing. The striking plate 1126A may be mounted in the striking plate recess of the striking wall portion 1126C of the face component 1126A. The striking plate 1126A may cover at least one or more of the weights that are attached or located near the cup face assembly 1126. Additionally, the return portion 1126D may provide a good surface for which the exterior skin 128 can be attached, either by adhesives or mechanical connections. The cup face assembly 1126 (or even a simple ball striking face plate) may make the need for tubes and/or weights around the perimeter of the face unnecessary (e.g., if these faces are structurally strong enough that the additional support of tubes is unnecessary), and thus, they can be omitted from the structure, if desired.

Figure 12A:
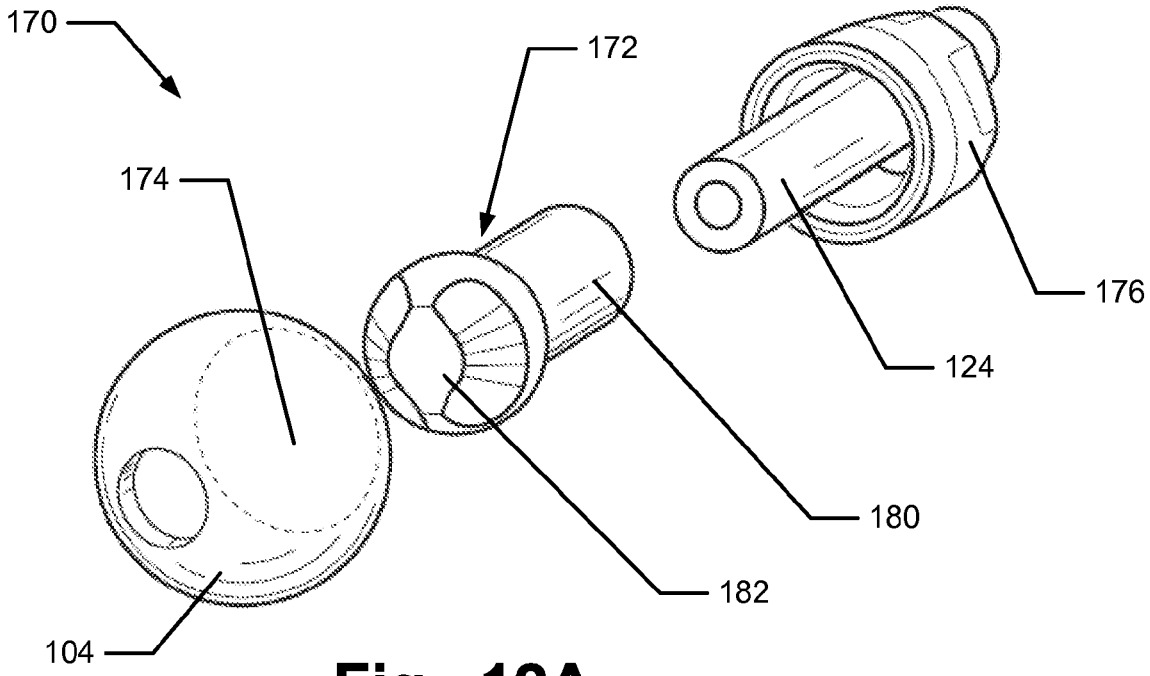
FIG. 12A illustrates a side/bottom perspective view of a releasable connection for a golf club head and shaft in accordance with some examples of this invention.
Figure 12B:
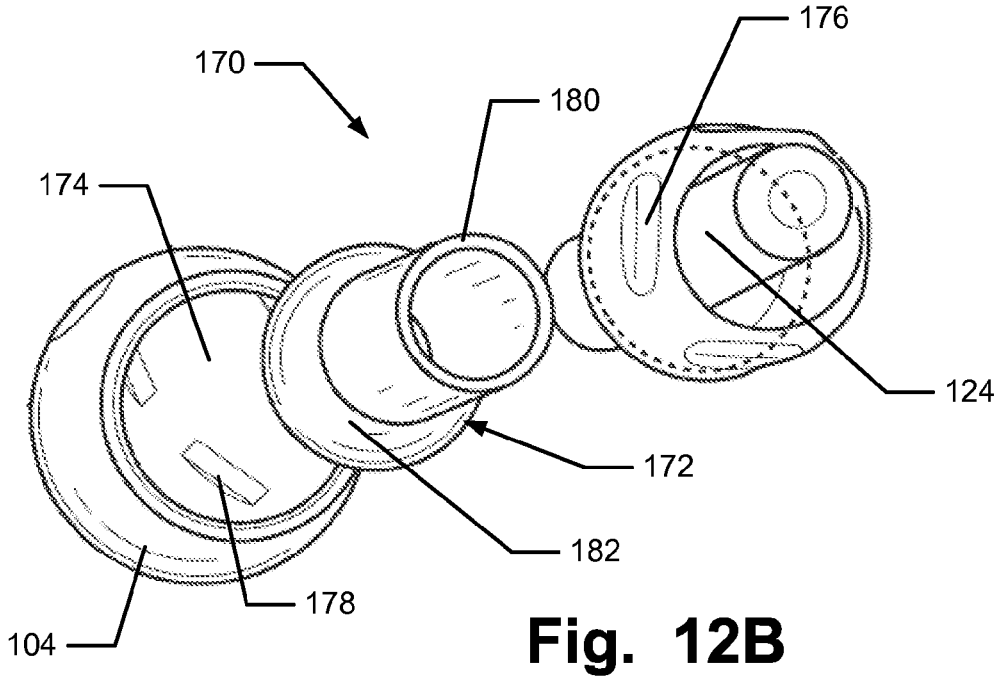
FIG. 12B illustrates an exploded top perspective view of the connection of FIG. 12A in accordance with examples of this invention.

As illustrated in FIGS. 12A and 12B, in addition to the features as described above, the club head may include a pivotal connection assembly 170 for connecting a shaft to the club head. The pivotal connection assembly 170 in accordance with aspects of this invention may include a shaft adapter 172, a hosel weight insert 174, and a shaft retainer 176. The hosel weight insert 174 may be at least partially located within one of the plurality of weights (for example the fourth weight 104 as shown in FIG. 2A). The shaft adapter 172 may be releasably connected to the hosel weight insert 174. The shaft retainer 176 may be slidably engaged along the golf club shaft 124 and may be secured to the hosel weight insert 174, thereby securing the shaft adapter 172 firmly against the hosel weight insert 174.

As shown in FIGS. 12A and 12B, one of the plurality of weights (as illustrated the fourth weight 104) may be configured to receive the hosel weight insert 174. The hosel weight insert 174 may include a rotation inhibiting structure 178. Illustrative rotation inhibiting structures 178 that may be used in accordance with embodiments of the invention may also include a faceted ball connection assembly, a pinned ball connection assembly, a pin-and-hole connection assembly, and a tabbed ball connection assembly as disclosed in U.S. patent application Ser. No. 12/269,662 filed Nov. 12, 2008 in the names of Raymond Sander, et al., which application is entirely incorporated herein by reference.

The hosel weight insert 174 is configured to releasably receive and secure the shaft retainer 176. As shown in FIGS. 12A and 12B, the example hosel weight insert 174 comprises threaded securing structures that are configured to threadingly engage threaded structures of a complementing shaft retainer 176. The use of threaded structures permits tight precise fittings and allows for the quick separation of the golf club head 120 from the shaft retainer 176. While threaded securing structures may be used in certain embodiments, those of skill in the art will readily appreciate that any hosel weight insert 174 that releasably receives and secures a shaft retainer 176 is within the scope of the invention. For example, the hosel weight insert 174 may include other structures that hold a shaft retainer 176 in place. If desired, slots, openings, or grooves that provide access to structures extending from or into the hosel weight insert 174 and/or the shaft retainer 176 may be used to hold these components in place with respect to one another.

The shaft adapter 172 has an upper end 180 and a spherical member 182 opposite the upper end 180. The upper end 180 may be configured to securely attach to a club shaft 124, e.g., by cements or adhesives, by mechanical connectors (optionally releasable connectors), by friction fit, etc. As seen in FIGS. 12A and 12B, the illustrative shaft adapter 172 may be hollow and may be sized to receive a free end portion of a golf shaft 124. Those of skill in the art will readily appreciate that the shaft adapter 172 is not required to be hollow and may securely attach to a club shaft 124 by any suitable methods and mechanisms, including for example, e.g., via cements or adhesives; via welding, brazing, soldering, or other fusing techniques; via mechanical connectors; via a friction fit; etc. Further, the connection of the shaft adapter 172 to the golf club shaft 124 may be releasable, so as to allow the shaft to be easily and quickly switched. Yet, in other embodiments, the shaft adapter 172 may be integral to or otherwise permanently affixed to the shaft. This may be advantageous, for example, to prevent a user from using a less-than desirable shaft with a specific club head 120.

The spherical member 182 may be configured to releasably mate with the hosel weight insert 174. There may be many different examples of how the spherical member 182 and shaft adapter 172 can mate to the hosel weight insert 174. The spherical member 182 of the shaft adapter 172 may take on a wide variety of forms in the pivotal connection assembly 170 in accordance with examples of this invention. As seen in FIGS. 12A and 12B, the spherical member 182 is configured to mate with at least a portion of the rotation inhibiting structure 178 of the hosel weight insert 174.

Additional aspects of this pivotal connection assembly relate to the spherical member 182 having a direction change region. Pivotal connection assemblies 170 in accordance with this invention may enable club fitters (or others) to adjust various positions and/or angles of the ball striking face with respect to the shaft 124 (e.g., face angle, lie angle, loft angle, etc.). Any desired axial direction change angle may be used without departing from this invention, e.g., at least 0.25 degrees, at least 0.5 degrees, at least 1 degree, at least 2 degrees, at least 2.5 degrees, at least 4 degrees, or at least 8 degrees.

Depending on how the shaft adapter 172 is placed within one of the plurality of weights 104, and thus how the axial direction change region is oriented in relation to the ball striking face, the playing characteristics of the club may be modified. This feature, along with the pivotal connection assembly 170, allows club fitters (or others) to freely and easily adjust various angles and/or positions of the shaft 124 with respect to the club head 120 (e.g., variable lie, loft, and face angle combinations) while still using the same shaft 124 and/or head 120, which can help users more easily determine the optimum club head/shaft combination and arrangement to suit their needs.

If desired, the shaft adapter 172 and/or some portion of the club head 120 may be marked with indicia to indicate the rotational position of the shaft adapter 172 with respect to the club head 120, e.g., to allow users to better record the club head/shaft orientation and/or to allow a reliable return to a previous position after rotation of the shaft 124 has taken place.

The shaft retainer 176 may be configured to be secured by the hosel weight insert 174 within one of the plurality of weights. The shaft retainer 176 may comprise threaded securing structures configured to threadingly engage threaded structures of the hosel weight insert 174. The threaded securing structures are merely an example of one implementation to releasably secure the shaft retainer 176 to one of the plurality of weights and the club head. The shaft retainer 176, however, may include other structures in addition to or in place of the threaded securing structures that may aid the securing and/or releasing of the shaft retainer 176 from the hosel weight insert 174.

Figure 13A:
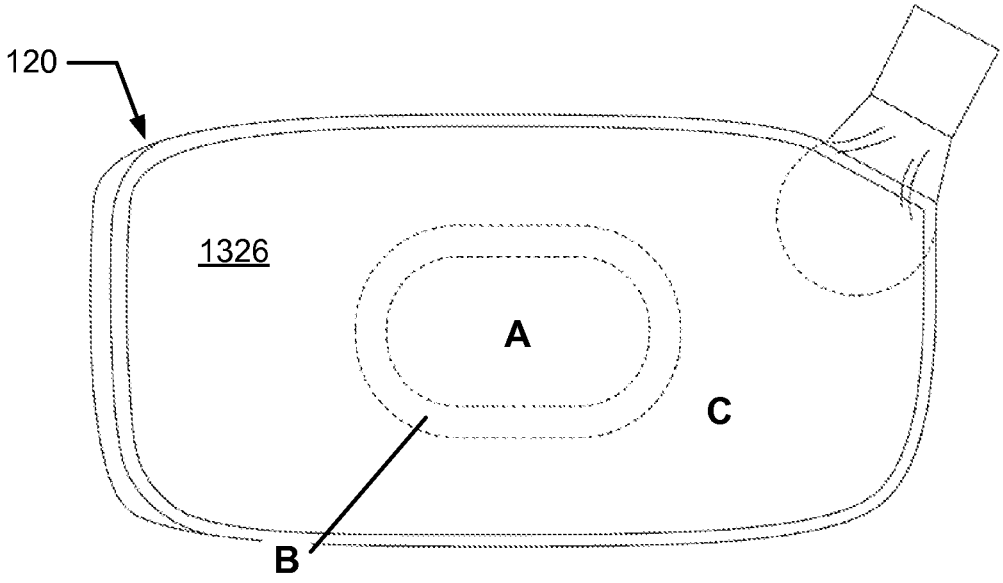
FIGS. 13A and 13B illustrate various views of a wood-type golf club head and its ball striking face in accordance with another example of this invention.
Figure 13B:
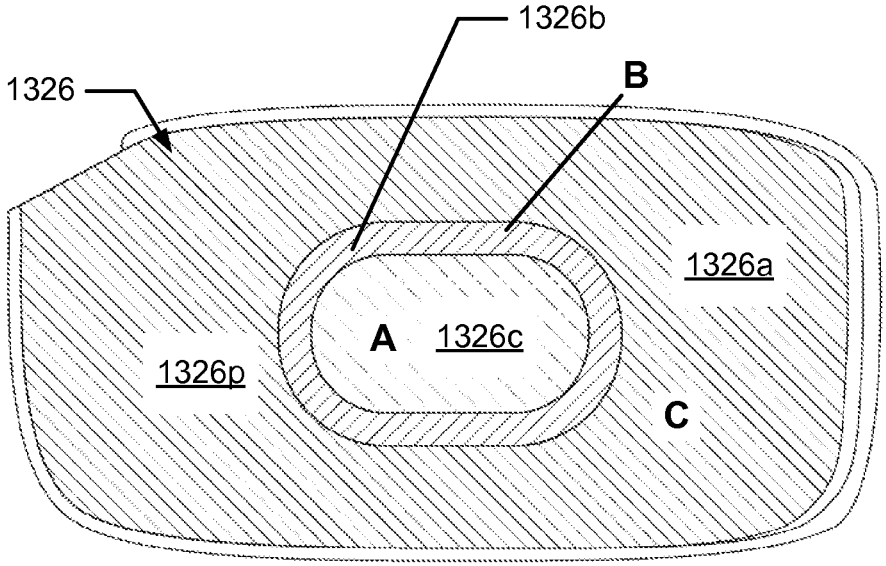

In addition to the features as described above, a variable face thickness on the ball striking face 1326 may be utilized in accordance with at least some example structures according to this invention. In this illustrated example, as shown in FIGS. 13A and 13B, the ball striking face 1326 is made thicker in the central area 1326*c* (region "A" in the drawings, where ball strikes typically occur) and thinner around this central area 1326*c* and around the perimeter (area 1326*p*) (region "C" in the drawings). A transition region 1326*b* located on the interior of the club head 120 (opposite the ball striking face surface—region "B" in the drawings) gradually slopes or otherwise transitions the face thickness between the thicker central region 1326*c* and the thinner perimeter region 1326*p*. The variable face thickness may be advantageous in that it provides a thick, strong face at the location of typical ball strikes while providing a relatively thin and/or flexible perimeter (to increase the club head's coefficient of restitution or "COR"). Club heads 120 in accordance with examples of this invention may have any desired COR value, including at least 0.75, at least 0.8, at least 0.81, at least 0.82, at least 0.83, or even higher. Also, while FIGS. 13A and 13B illustrate a single thicker face portion 1326*c* on the ball striking face 1326*a* (substantially centrally located on the ball striking face 1326*a* (surrounded by a single, continuous, thinner perimeter region)), the number, relative sizes, locations, dimensions, and other features of the various thick and thin regions of a ball striking face 1326 may be varied without departing from this invention.

Figure 14A:
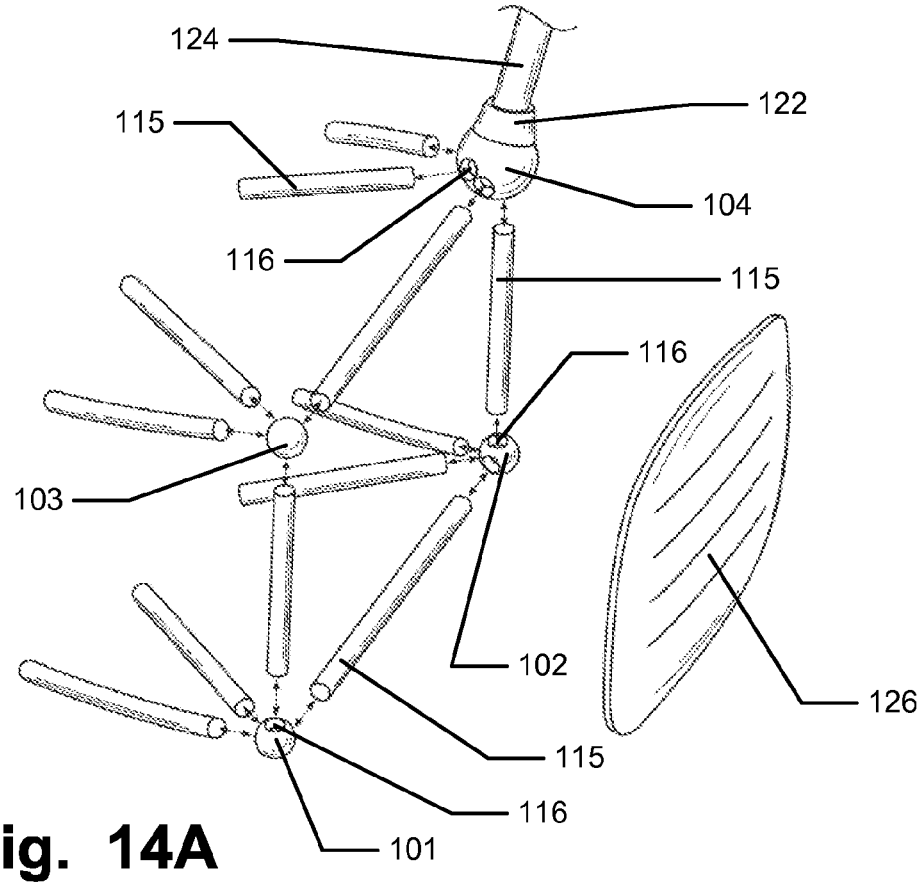
FIG. 14A illustrates a partial internal front perspective assembly view of the golf club head of FIG. 2A in accordance with examples of this invention.
Figure 14B:
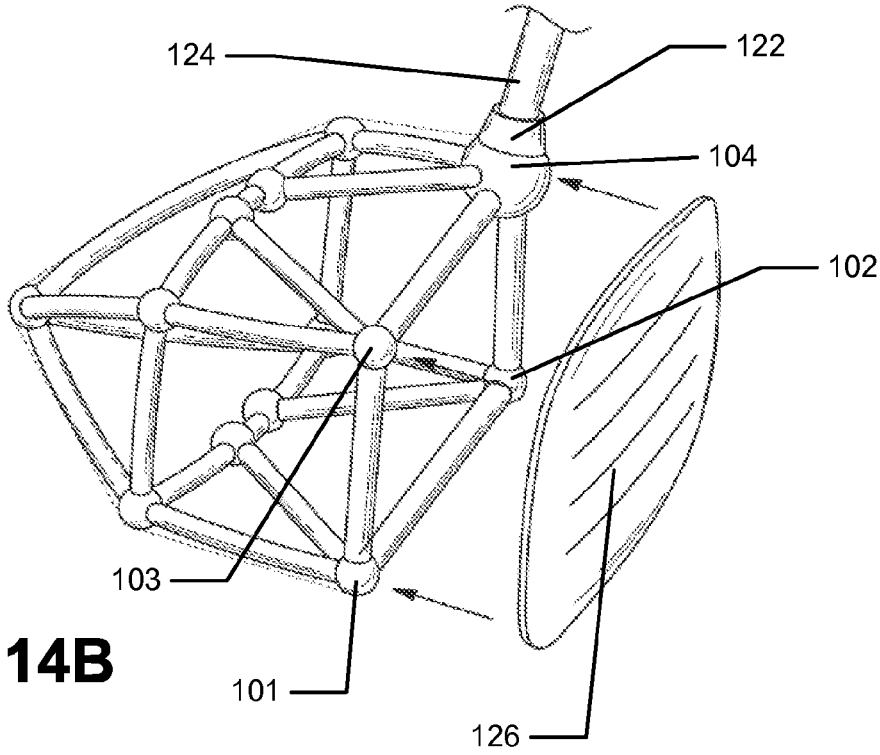
FIG. 14B illustrates an internal front perspective assembly view of the golf club head of FIG. 14A in accordance with examples of this invention.

As described above, the weights and tubes of golf club head structures in accordance with examples of this invention may be joined together by various methods, such as through the use of cements or adhesives; mechanical connectors, optionally releasable mechanical connections; and/or welding, soldering, brazing, or other fusing techniques. If desired, a finish may be applied over to conceal the area where the parts are joined together (e.g., paint, chrome or other metal plating, polymeric coatings, etc.).A method of assembling a wood-type golf club is illustrated in FIGS. 14A and 14B in accordance with at least one example wood-type golf club from this invention. The method may comprise the following steps: (a) engaging a plurality of weights 101-113 with a plurality of tubes 115 by inserting an end of the tube into a tube receiving port 116 of the weight 101-113; (b) connecting a ball striking face 126 with at least two of the plurality of weights 101-113 and at least two of the plurality of tubes 115; (c) covering at least a portion of the plurality of weights 101-113 and at least a portion of the plurality of tubes 115 with an exterior skin 128 wherein the exterior skin 128 defines the shape of a club head 120 that includes a heel, a toe, a crown, a sole, a front, and a rear; (d) engaging a golf club shaft 124 with the club head 120, wherein the golf club shaft 124 is adapted to be received in a hosel 122 of the club head 120; and (e) engaging a grip member with the shaft 124. Additionally, one or more of the plurality of weights may include two, three, or four tube receiving ports. In other example embodiments of the invention, one or more of the plurality of weights may include more than four tube receiving ports.

Many modifications to the overall club head structures and/or the overall golf club structures may be made without departing from this invention. For example, many modifications may be made to the part or parts making up the club head structures, to the materials used in making the club head structures, to the manner in which the parts of the club head structures are joined together, etc. Also, many modifications may be made to the thickness, weight, shape, size, and/or other physical characteristics of the part or parts making up the overall golf club structure, etc. Further modifications may be made in the manner in which the club head and its associated parts are made, including modifications in the specific processes used to make the parts, modifications in the materials used to make the parts, modifications to the order in which the parts are made and the club head is assembled, and the like.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head comprising:

a hosel adapted to receive a golf club shaft;

a club head including:

a plurality of weights, a plurality of tubes that connect the plurality of weights, and an exterior skin that covers at least a portion of the plurality of weights and at least a portion of the plurality of tubes wherein the exterior skin defines the shape of the club head that includes a heel, a toe, a crown, a sole, a front, and a rear, wherein the plurality of weights includes:

a first weight located at the front, the sole, and the toe, a second weight located at the front, the crown, and the toe, a third weight located at the front, the sole, and the heel, and a fourth weight located at the front, the crown, and the heel, and wherein one of the plurality of tubes connects the first weight and the second weight, one of the plurality of tubes connects the first weight and the third weight, one of the plurality of tubes connects the second weight and the fourth weight, and one of the plurality of tubes connects the third weight and the fourth weight; and a ball striking face engaged with at least two of the plurality of weights and at least two of the tubes, wherein the ball striking face extends from the toe to the heel.

2. A golf club head according to claim 1, wherein the first weight, the second weight, the third weight, and the fourth weight engage the striking face.

3. A golf club head according to claim 1, wherein the tubes that connect the first weight, the second weight, the third weight, and the fourth weight are engaged with the striking face.

4. A golf club head according to claim 1, wherein the at least one of the tubes that connect the first weight, the second weight, the third weight, and the fourth weight are not engaged with the striking face.

5. A golf club head according to claim 1, wherein the plurality of weights includes:

a fifth weight located at the sole, the toe, and midway between the front and the rear;

a sixth weight located at the crown, the toe, and midway between the front and the rear;

a seventh and an eighth weights located at the sole, midway between the toe and the heel, and midway between the front and the rear, a ninth and tenth weights located at the crown, midway between the toe and the heel, and midway between the front and the rear, an eleventh weight located at the sole, the heel, and midway between the front and the rear, a twelfth weight located at the crown, the heel, and midway between the front and the rear, and a thirteenth weight located at the rear, midway between the sole and the crown, and midway between the toe and the heel.

6. A golf club head according to claim 5, wherein one of the plurality of tubes connects the first weight and the fifth weight, one of the plurality of tubes connects the first weight and the seventh weight, one of the plurality of tubes connects the second weight and the sixth weight, one of the plurality of tubes connects the second weight and the ninth weight, one of the plurality of tubes connects the third weight and the eighth weight, one of the plurality of tubes connects the third weight and the eleventh weight, one of the plurality of tubes connects the fourth weight and the tenth weight, one of the plurality of tubes connects the fourth weight and the twelfth weight, one of the plurality of tubes connects the fifth weight and the seventh weight, one of the plurality of tubes connects the fifth weight and the sixth weight, one of the plurality of tubes connects the fifth weight and the thirteenth weight, one of the plurality of tubes connects the sixth weight and the ninth weight, one of the plurality of tubes connects the sixth weight and the thirteenth weight, one of the plurality of tubes connects the seventh weight and the eighth weight, one of the plurality of tubes connects the eighth weight and the eleventh weight, one of the plurality of tubes connects the ninth weight and the tenth weight, one of the plurality of tubes connects the tenth weight and the twelfth weight, one of the plurality of tubes connects the eleventh weight and the twelfth weight, one of the plurality of tubes connects the eleventh weight and the thirteenth weight, and one of the plurality of tubes connects the twelfth weight and the thirteenth weight.

7. A golf club head according to claim 1, wherein the hosel is constructed at least in part from a titanium, an aluminum, or a stainless steel containing material.

8. A golf club head according to claim 1, wherein the hosel includes a pivotal portion to adjust a loft angle and a lie angle of the striking face.

9. A golf club head according to claim 1, wherein the weights are made of steel.

10. A golf club head according to claim 1, wherein the tubes are composite tubes.

11. A golf club head according to claim 10, wherein the composite tubes are made of composite materials selected from the group of: fiber, carbon fiber composite materials, basalt fiber composite materials, or fiberglass materials.

12. A golf club head according to claim 1, wherein each of the plurality of weights have a mass between approximately 1 and 15 grams.

13. A golf club head according to claim 1, wherein the ball striking face has a variable face thickness.

14. A golf club head according to claim 13, wherein a central area of the ball striking face is thicker than a perimeter area of the ball striking face.

15. A golf club head according to claim 13, wherein the ball striking face has a central area having a first thickness, a perimeter area having a second thickness, and at least one transition region at least partially transitioning from the first thickness to the second thickness.

16. A wood-type golf club comprising:

a hosel adapted to receive a golf club shaft;

a club head including:

a plurality of weights, a plurality of tubes that connect the plurality of weights, and an exterior skin that covers at least a portion of the plurality of weights and at least a portion of the plurality of tubes wherein the exterior skin defines the shape of the club head that includes a heel, a toe, a crown, a sole, a front, and a rear, wherein the plurality of weights includes:

a first weight located at the front, the sole, and the toe, a second weight located at the front, the crown, and the toe, a third weight located at the front, the sole, and the heel, and a fourth weight located at the front, the crown, and the heel, and wherein one of the plurality of tubes connects the first weight and the second weight, one of the plurality of tubes connects the first weight and the third weight, one of the plurality of tubes connects the second weight and the fourth weight, and one of the plurality of tubes connects the third weight and the fourth weight; and a ball striking face engaged with at least two of the plurality of weights and at least two of the tubes, wherein the ball striking face extends from the toe to the heel, wherein the golf club shaft is engaged with the club head at the hosel.

17. A wood-type golf club according to claim 16, wherein the first weight, the second weight, the third weight, and the fourth weight engage the striking face.

18. A wood-type golf club according to claim 17, wherein the plurality of weights includes:

a fifth weight located at the sole, the toe, and midway between the front and the rear;

a sixth weight located at the crown, the toe, and midway between the front and the rear;

a seventh and an eighth weights located at the sole, midway between the toe and the heel, and midway between the front and the rear, a ninth and tenth weights located at the crown, midway between the toe and the heel, and midway between the front and the rear, an eleventh weight located at the sole, the heel, and midway between the front and the rear, a twelfth weight located at the crown, the heel, and midway between the front and the rear, and a thirteenth weight located at the rear, midway between the sole and the crown, and midway between the toe and the heel.

19. A wood-type golf club according to claim 18, wherein one of the plurality of tubes connects the first weight and the fifth weight, one of the plurality of tubes connects the first weight and the seventh weight, one of the plurality of tubes connects the second weight and the sixth weight, one of the plurality of tubes connects the second weight and the ninth weight, one of the plurality of tubes connects the third weight and the eighth weight, one of the plurality of tubes connects the third weight and the eleventh weight, one of the plurality of tubes connects the fourth weight and the tenth weight, one of the plurality of tubes connects the fourth weight and the twelfth weight, one of the plurality of tubes connects the fifth weight and the seventh weight, one of the plurality of tubes connects the fifth weight and the sixth weight, one of the plurality of tubes connects the fifth weight and the thirteenth weight, one of the plurality of tubes connects the sixth weight and the ninth weight, one of the plurality of tubes connects the sixth weight and the thirteenth weight, one of the plurality of tubes connects the seventh weight and the eighth weight, one of the plurality of tubes connects the eighth weight and the eleventh weight, one of the plurality of tubes connects the ninth weight and the tenth weight, one of the plurality of tubes connects the tenth weight and the twelfth weight, one of the plurality of tubes connects the eleventh weight and the twelfth weight, one of the plurality of tubes connects the eleventh weight and the thirteenth weight, and one of the plurality of tubes connects the twelfth weight and the thirteenth weight.

20. A wood-type golf club according to claim 16, wherein the tubes that connect the first weight, the second weight, the third weight, and the fourth weight are engaged with the striking face.

21. A wood-type golf club according to claim 16, wherein the at least one of the tubes that connect the first weight, the second weight, the third weight, and the fourth weight are not engaged with the striking face.

22. A wood-type golf club according to claim 16, wherein the hosel includes a pivotal portion to adjust the loft angle and the lie angle of the striking face.

23. A wood-type golf club according to claim 16, wherein each of the plurality of weights have a mass between approximately 1 and 15 grams.

24. A method of making a wood-type golf club, the method comprising the steps of:

(a) providing a club head, wherein the club head includes: a plurality of weights, a plurality of tubes that connect the plurality of weights, and an exterior skin that covers at least a portion of the plurality of weights and at least a portion of the plurality of tubes wherein the exterior skin defines the shape of the club head that includes a heel, a toe, a crown, a sole, a front, and a rear, wherein the plurality of weights includes:

a first weight located at the front, the sole, and the toe, a second weight located at the front, the crown, and the toe, a third weight located at the front, the sole, and the heel, and a fourth weight located at the front, the crown, and the heel, and further wherein one of the plurality of tubes connects the first weight and the second weight, one of the plurality of tubes connects the first weight and the third weight, one of the plurality of tubes connects the second weight and the fourth weight, and one of the plurality of tubes connects the third weight and the fourth weight;

(b) providing a ball striking face engaged with at least two of the plurality of weights and at least two of the tubes, wherein the ball striking face extends from the toe to the heel;

(c) engaging a golf club shaft with the club head, wherein the golf club shaft is adapted to be received in a hosel of the club head; and (d) engaging a grip member with the shaft.

25. A method according to claim 24, wherein the first weight, the second weight, the third weight, and the fourth weight engage the striking face.

26. A method according to claim 24, wherein the tubes that connect the first weight, the second weight, the third weight, and the fourth weight are engaged with the striking face.

27. A method according to claim 24, wherein the at least one of the tubes that connect the first weight, the second weight, the third weight, and the fourth weight are not engaged with the striking face.

28. A method according to claim 24, wherein the hosel includes a pivotal portion to adjust the loft angle and the lie angle of the striking face.

29. A method of assembling a wood-type golf club, the method comprising the steps of:

(a) engaging a plurality of weights with a plurality of tubes by inserting an end of the tube into a tube receiving port of the weights, wherein at least a portion of the plurality of weights includes two tube receiving ports;

(b) connecting a ball striking face with at least two of the plurality of weights and at least two of the plurality of tubes;

(c) covering at least a portion of the plurality of weights and at least a portion of the plurality of tubes with an exterior skin wherein the exterior skin defines the shape of a club head that includes a heel, a toe, a crown, a sole, a front, and a rear;

(d) engaging a golf club shaft with the club head, wherein the golf club shaft is adapted to be received in a hosel of the club head; and (e) engaging a grip member with the shaft.

30. A method according to claim 29, wherein the plurality of weights includes:

a first weight located at the front, the sole, and the toe, a second weight located at the front, the crown, and the toe, a third weight located at the front, the sole, and the heel, and a fourth weight located at the front, the crown, and the heel.

31. A method according to claim 29, wherein at least a portion of the plurality of weights includes three tube receiving ports.

32. A method according to claim 29, wherein at least a portion of the plurality of weights includes four tube receiving ports.

33. A method according to claim 29, wherein the hosel includes a pivotal portion to adjust the loft angle and the lie angle of the striking face.

34. A wood-type golf club comprising:

a hosel adapted to receive a golf club shaft;

a club head including:

a plurality of weights, a plurality of tubes that connect the plurality of weights, and an exterior skin that covers at least a portion of the plurality of weights and at least a portion of the plurality of tubes wherein the exterior skin defines the shape of the club head that includes a heel, a toe, a crown, a sole, a front, and a rear, wherein the plurality of weights includes:

a first weight located at the front, the sole, and the toe, a second weight located at the front, the crown, and the toe, a third weight located at the front, the sole, and the heel, and a fourth weight located at the front, the crown, and the heel, a fifth weight located at the sole, the toe, and midway between the front and the rear;

a sixth weight located at the crown, the toe, and midway between the front and the rear;

a seventh and an eighth weights located at the sole, midway between the toe and the heel, and midway between the front and the rear, a ninth and tenth weights located at the crown, midway between the toe and the heel, and midway between the front and the rear, an eleventh weight located at the sole, the heel, and midway between the front and the rear, a twelfth weight located at the crown, the heel, and midway between the front and the rear, and a thirteenth weight located at the rear, midway between the sole and the crown, and midway between the toe and the heel; and a ball striking face engaged with at least two of the plurality of weights and at least two of the tubes, wherein the ball striking face extends from the toe to the heel, wherein the golf club shaft is engaged with the club head at the hosel, and further wherein the first weight, the second weight, the third weight, and the fourth weight engage the striking face.

35. A wood-type golf club according to claim 34, wherein one of the plurality of tubes connects the first weight and the second weight, one of the plurality of tubes connects the first weight and the third weight, one of the plurality of tubes connects the second weight and the fourth weight, and one of the plurality of tubes connects the third weight and the fourth weight.

36. A wood-type golf club according to claim 35, wherein the tubes that connect the first weight, the second weight, the third weight, and the fourth weight are engaged with the striking face.

37. A wood-type golf club according to claim 35, wherein the at least one of the tubes that connect the first weight, the second weight, the third weight, and the fourth weight are not engaged with the striking face.

38. A wood-type golf club according to claim 34, wherein one of the plurality of tubes connects the first weight and the fifth weight, one of the plurality of tubes connects the first weight and the seventh weight, one of the plurality of tubes connects the second weight and the sixth weight, one of the plurality of tubes connects the second weight and the ninth weight, one of the plurality of tubes connects the third weight and the eighth weight, one of the plurality of tubes connects the third weight and the eleventh weight, one of the plurality of tubes connects the fourth weight and the tenth weight, one of the plurality of tubes connects the fourth weight and the twelfth weight, one of the plurality of tubes connects the fifth weight and the seventh weight, one of the plurality of tubes connects the fifth weight and the sixth weight, one of the plurality of tubes connects the fifth weight and the thirteenth weight, one of the plurality of tubes connects the sixth weight and the ninth weight, one of the plurality of tubes connects the sixth weight and the thirteenth weight, one of the plurality of tubes connects the seventh weight and the eighth weight, one of the plurality of tubes connects the eighth weight and the eleventh weight, one of the plurality of tubes connects the ninth weight and the tenth weight, one of the plurality of tubes connects the tenth weight and the twelfth weight, one of the plurality of tubes connects the eleventh weight and the twelfth weight, one of the plurality of tubes connects the eleventh weight and the thirteenth weight, and one of the plurality of tubes connects the twelfth weight and the thirteenth weight.

39. A wood-type golf club according to claim 34, wherein the hosel includes a pivotal portion to adjust the loft angle and the lie angle of the striking face.

40. A wood-type golf club according to claim 34, wherein each of the plurality of weights have a mass between approximately 1 and 15 grams.

* * * * *